US010342303B2

(12) United States Patent
Yamakawa et al.

(10) Patent No.: US 10,342,303 B2
(45) Date of Patent: Jul. 9, 2019

(54) BAND

(71) Applicant: CITIZEN WATCH CO., LTD., Tokyo (JP)

(72) Inventors: Jindai Yamakawa, Saitama (JP); Takuya Shoji, Tokyo (JP)

(73) Assignee: CITIZEN WATCH CO., LTD., Tokyo ( * ) Notice: Subject to any disclaimer, the term of this patent is extended or adjusted under 35 U.S.C. 154(b) by 0 days.

(21) Appl. No.: 15/521,445

(22) PCT Filed: Oct. 13, 2015

(86) PCT No.: PCT/JP2015/078947
§ 371 (c)(1),
(2) Date: Apr. 24, 2017

(87) PCT Pub. No.: WO2016/067912
PCT Pub. Date: May 6, 2016

(65) Prior Publication Data

US 2017/0311685 A1 Nov. 2, 2017

(30) Foreign Application Priority Data

Oct. 30, 2014 (JP) ..... 2014-221931

(51) Int. Cl.
*A44C 5/10* (2006.01)

(52) U.S. Cl.
CPC ..... *A44C 5/105* (2013.01); *A44C 5/107* (2013.01)

(58) Field of Classification Search
CPC ..... A44C 5/105; A44C 5/107; F16G 15/14; F16G 13/16
USPC ..... 59/82
See application file for complete search history.

(56) References Cited

U.S. PATENT DOCUMENTS 1,520,186 A * 12/1924 Kestenman ..... A44C 5/08 59/79.2
1,720,235 A * 7/1929 Prestinari ..... A44C 5/02 59/80
1,808,140 A * 6/1931 Kestenman ..... A44C 5/107 59/80
1,854,857 A * 4/1932 Prestinari ..... A44C 5/02 59/80

(Continued)

FOREIGN PATENT DOCUMENTS

CN 1053740 A 8/1991
CN 1032187 C 7/1996

(Continued)

OTHER PUBLICATIONS

International Search Report for PCT/JP2015/078947, dated Jan. 12, 2016.

(Continued)

*Primary Examiner* — David B Jones

(57) ABSTRACT

A band comprised of a plurality of link members connected to each other to be able to pivot by pivot shafts, in the band, at least one of the plurality of link members has a sheet member and a wrapped member around which the sheet member is wrapped, the wrapped member has a side part facing an adjoining link member, and at least one end part of the sheet member is arranged between a top end part and bottom end part of the side part in the thickness direction.

10 Claims, 20 Drawing Sheets

(56) References Cited

U.S. PATENT DOCUMENTS

| | | | | | |
|---|---|---|---|---|---|
| 2,457,275 | A * | 12/1948 | Ritter | A44C 5/04 59/79.3 |
| 2,732,684 | A * | 1/1956 | Augenstein | A44C 5/08 59/79.2 |
| 3,930,364 | A | 1/1976 | Wong | |
| 5,154,047 | A | 10/1992 | Takagi | |
| 6,170,250 | B1 * | 1/2001 | Hara | A44C 5/107 59/80 |

FOREIGN PATENT DOCUMENTS

| | | | |
|---|---|---|---|
| CN | 1287477 | A | 3/2001 |
| DE | 2133008 | A1 | 1/1973 |
| EP | 1048240 | A1 | 11/2000 |
| GB | 2178942 | A | 2/1987 |
| JP | S48-021667 | U | 3/1973 |
| JP | S55-104908 | U | 7/1980 |
| JP | S56-044011 | U | 4/1981 |
| JP | S56-83212 | U | 7/1981 |
| JP | S56-051775 | Y | 12/1981 |
| JP | S59-005368 | Y | 2/1984 |
| JP | S59-034610 | U | 3/1984 |
| JP | S59-029543 | Y | 8/1984 |
| JP | S60-97012 | U | 7/1985 |
| JP | S62-000493 | Y | 1/1987 |
| JP | S62-66503 | U | 4/1987 |
| JP | H04-014016 | Y | 3/1992 |
| JP | H11-192111 | A | 7/1999 |
| JP | 2001-008716 | A | 1/2001 |
| JP | 2002-186508 | A | 7/2002 |
| JP | 2003-009916 | A | 1/2003 |
| JP | 2003-325210 | A | 11/2003 |

OTHER PUBLICATIONS

International Preliminary Report on Patentability for PCT/JP2015/078947, dated Jan. 12, 2016.

State Intellectual Property Office of the People's Republic of China, First Office Action for Chinese Patent Application No. 201580059199.8, dated Jun. 22, 2018.

Japan Patent Office, Office Action for Japanese Patent Application No. 2016-556491, dated Mar. 5, 2019.

China National Intellectual Property Administration, Second Office Action for 201580059199.8, dated Mar. 14, 2019.

* cited by examiner (a)

(b)

(c)

(e)

(f)

(g)

(h)

(a)

(b)

(c)

BAND

TECHNICAL FIELD

The present invention relates to a band for watch use, decorative use, etc. comprising link members connected forming the band.

BACKGROUND ART

FIG. 30(*a*) is a perspective view showing a prior art. FIG. 30(*b*) is a plan view of the prior art of FIG. 30(*a*) seen from above. FIG. 30(*c*) is a plan view of the prior art of FIG. 30(*a*) seen from below. FIG. 31(*a*) is a perspective view showing the prior art. FIG. 31(*b*) is a disassembled perspective view of the prior art of FIG. 31(*a*). FIG. 31(*c*) is a plan view of the prior art of FIG. 31(*a*) seen from above. FIG. 31(*d*) is a plan view of the prior art of FIG. 31(*a*) seen from below. FIG. 32(*a*) is a perspective view showing the prior art seen from the back side. FIG. 32(*b*) is a partial enlarged perspective view of the back surface of FIG. 32(*a*). FIG. 33 is a perspective view showing the prior art of the present invention.

As prior art, as structures of a link member of the band, (1) a structure obtained by press-forming or forging, cutting, etc. (below, called "solid type"), (2) a structure combining solid members (below, called "separate type"), (3) a structure obtained by stamping, bending, forming, and otherwise press-forming a sheet member (below, called "sheet metal type"), (4) a structure obtained by wrapping a sheet member around an integrally formed link member (below, called "wrap around type"), etc. are known.

In a watch band etc., as the link members to be connected, ones with a solid feel and heavy appearance are preferred. For this reason, as shown in FIGS. 30(*a*) to (*c*), "solid type" link members 110 where the outside link parts 102 and middle link parts 103 are integrally formed by press-forming, forging, etc. are known. In recent years, the need has arisen for increasing the design variations of watches themselves by design of the watch cases or watch bands. For this reason, to make the outside link parts 102 and the middle link parts 103 visually appear to be formed by separate members, it has been sought to treat the outside link parts 102 and the middle link parts 103 by different surface treatment or processing so create a luxury feel at the band. However, in the integrally formed "solid type", it was not possible to inexpensively and easily make the outside link parts 102 and middle link parts 103 appear to be separate members. Further, since the outside link parts 102 and the middle link parts 103 are treated by separate surface treatment or processing, the processing costs become high. For this reason, with a "solid type" link member 110, it was not that possible to obtain a high quality feel.

To deal with such a problem, as shown in FIGS. 31(*a*) to (*d*), a "separate type" link member 120 combining solid members is known. In this case, outside link parts 122 and middle link parts 123 are separately fabricated and then combined. As shown in FIG. 31(*b*), two outside link parts 122 positioned at the outsides in the width direction are connected by a connecting piece 125 at the back side. The middle link part 123 is provided with a step part 124 fitting with the connecting piece 125. A pin 160 is used to insert a pin into a pin hole 170 of the middle link part 123 to join the outside link parts 122 and the middle link part 123. Due to this, the outside link parts 122 and the middle link part 123 can appear as separate members and a heavy appearance with a solid feel can be obtained, so the look is excellent.

However, with a complicated link shape where the two outside link parts 122 and connecting piece 125 are integrally formed, high precision, costly processing has to be performed and the processing processes end up becoming numerous and troublesome, so sometimes stable quality could not be obtained.

As opposed to this, with the "sheet metal type", the parts assembled by manual work are reduced and costs are lowered, so numerous prior art are known such as PLTs 1 to 5 etc. In PLT 1, each link member to be connected is comprised of a single sheet folded into three layers to obtain an appearance of a solid member. The side surfaces in the band width direction are polished so that the boundaries of the superposed sheet pieces do not stand out, but still the high quality image of a solid member cannot be obtained. Further, wrapping pieces connecting the link members with each other had seams at the back surfaces, so there was the problem of burrs of the seams scratching the arm. PLT 2 also has parts at the back surfaces of the link members where recessed/projecting parts are engaged so there are problems similar to PLT 1.

In PLT 3 as well, steps are taken to prevent the bent and joined parts from being visible, but in the same way as PLT 1, the boundaries of the superposed sheet pieces are exposed at the side surfaces in the band width direction and a solid, high quality image could not be obtained. In PLT 4, each link member to be connected is comprised of a single sheet with front end edges engaged to strengthen the connection, then the seam of the front edges is covered by separate sheets sandwiching the sheet pieces from the top and bottom and welding them together, but again, problems similar to PLT 1 occur. PLT 5 also has the boundaries of superposed sheet pieces exposed at the side surfaces in the band width direction and thereby have problems similar to PLT 1.

To solve such problems, as the "wrap around type" where sheet members are wrapped around the link members, the watch bands of FIG. 32 and FIG. 33 are known. This type is comprised of a plurality of solid type links shown in FIG. 30 in which middle link parts are wrapped around by single sheet members. As shown in FIG. 32 and FIG. 33, the end parts of the sheet members wrapped around the middle link parts appear as seams at the back (under, bottom) surfaces, so there is the problem that the angles or burrs of the end parts will scratch the skin of the arm when a watch is worn. Since there were seams at the back surfaces, there was little of a high quality feeling in the appearance.

As something close to a "wrap around type", PLT 6 discloses a case-side link positioned at one end part of the watch band. This case-side link is attached to a band mount at a watch case. A link body made of plastic is covered by a cover member made of stainless steel or another metal sheet in this configuration. However, the two end parts of the cover member are present at the back surface of the case-side link, so there are problems similar to the watch band of FIG. 32 and FIG. 33.

CITATION LIST

Patent Literature

PLT 1: Japanese Utility Model Publication No. 59-005368Y
PLT 2: Japanese Utility Model Publication No. 59-029543Y
PLT 3: Japanese Patent Publication No. 2001-008716A
PLT 4: Japanese Utility Model Publication No. 59-034610U
PLT 5: Japanese Utility Model Publication No. 56-051775Y PLT 6: Japanese Patent Publication No. 11-192111A
PLT 7: Japanese Utility Model Publication No. 62-000493Y
PLT 8: Japanese Utility Model Publication No. 04-014016Y

SUMMARY OF INVENTION

Technical Problem

The problem is to provide a band partially wrapping sheet members around link members to increase the design variations and bringing out a high quality feeling such as formed by solid members by making the seams of the sheet members hard to see thanks to the connected link members.

Solution to Problem

The present invention provides a band having a plurality of link members connected to each other to be able to pivot by pivot shafts, wherein at least one of the plurality of link members has a sheet member and a wrapped member around which the sheet member is wrapped, the wrapped member has a side part facing an adjoining link member, and at least one end part of the sheet member is arranged between a top end part and bottom end part of the side part in the thickness direction.

Advantageous Effect of Invention

The seam of a sheet member wrapped around a link member is at a portion hard to see thanks to the connected link members, so a high quality feeling like a solid member is obtained. In particular, when using a precious metal such as gold or platinum for the sheet member, a beautiful appearance like a solid member is obtained and a special effect is created. Further, snags and burrs of end parts of the sheet member wrapped around the link member do not scratch the skin of the arm etc. and the feeling against the skin is also good. Furthermore, the surface treatment and surface finishing of the sheet member wrapped around the link member can be performed independently from the link member, so it is possible to pursue various design variations and possible to greatly reduce the costs compared with the prior art.

BRIEF DESCRIPTION OF DRAWINGS

FIG. 27(*b*) is an enlarged part of a part E of FIG. 27(*a*). FIG. 27(*c*) is an explanatory view explaining a shape where the two end parts of the link member at the back surface side are sunken in curved surfaces.

FIG. 30(*b*) is a plan view of the prior art of FIG. 30(*a*) seen from above. FIG. 30(*c*) is a plan view of the prior art of FIG. 30(*a*) seen from below.

FIG. 31(*b*) is a disassembled perspective view of the prior art of FIG. 31(*a*). FIG. 31(*c*) is a plan view of the prior art of FIG. 31(*a*) seen from above. FIG. 31(*d*) is a plan view of the prior art of FIG. 31(*a*) seen from below.

FIG. 32(*b*) is a partial enlarged perspective view of the back surface of FIG. 32(*a*).

DESCRIPTION OF EMBODIMENTS

Figure 1:
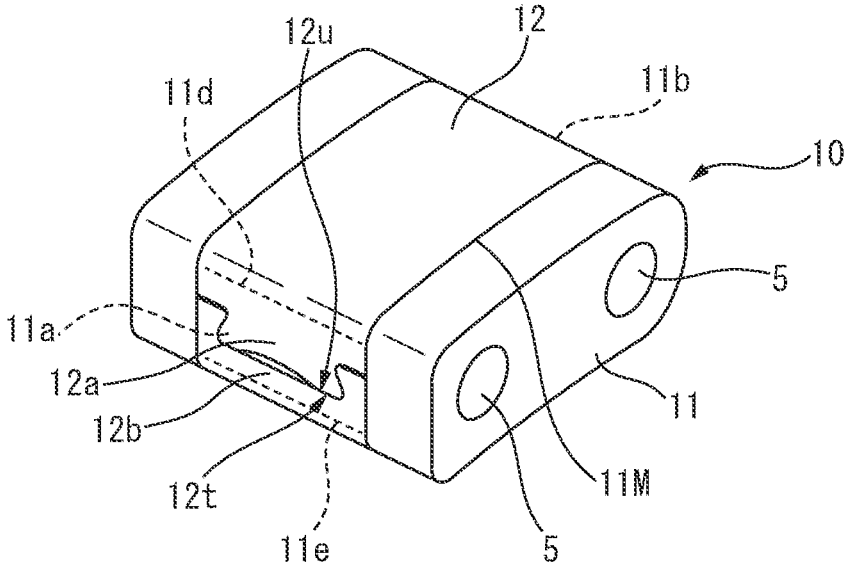
FIGS. 1(*a*) to (*c*) are perspective views showing a link member of a first embodiment of the present invention.
Figure 1:
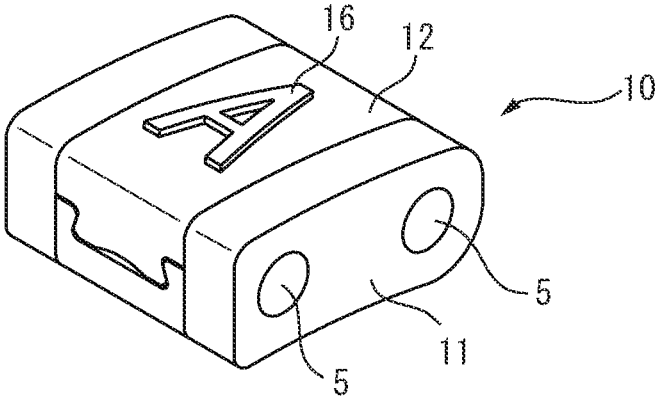
Figure 1:
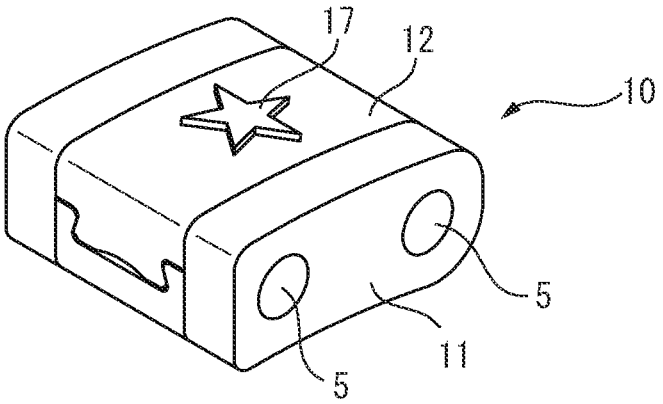

Below, referring to the drawings, embodiments of the present invention will be explained. In the embodiments, the same component parts are assigned the same reference notations and the explanations will be omitted. The following embodiments of the present invention are explained as embodiments of bands for wristwatches, but the invention is not necessarily limited to use for wristwatches. The present invention can also be applied to bands for obtaining a design effect such as for decorative use. Further, in the following embodiments, the link members were explained as so-called base blocks, projecting types, H-types, S-types, and several other types, but the present invention can also be applied to other embodiments.

First Embodiment

Figure 2:
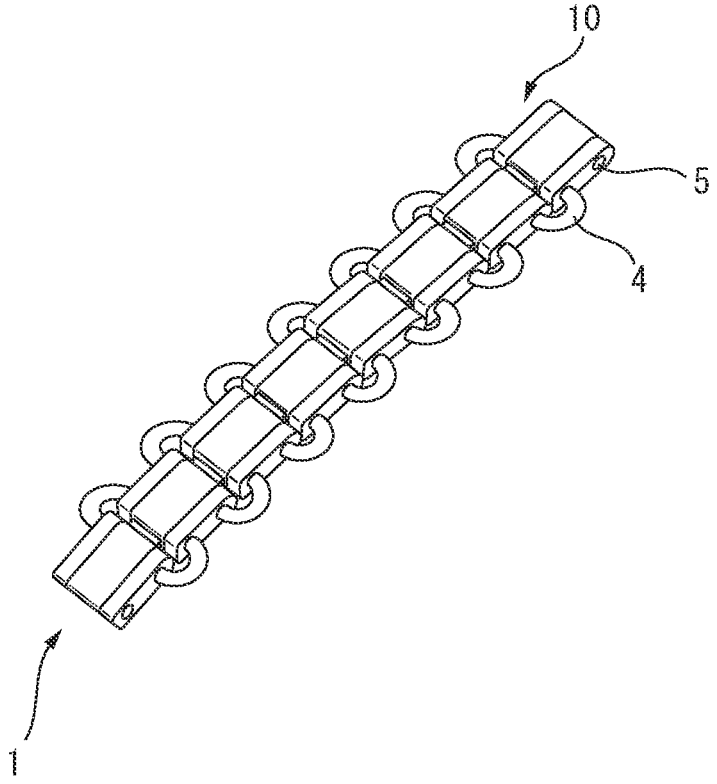
FIG. 2 is a perspective view showing the first embodiment of the present invention.

FIGS. 1(*a*) to (*c*) are perspective views showing a link member 10 of a first embodiment of the present invention. FIG. 2 is a perspective view showing the first embodiment of the present invention.

The first embodiment, as shown in FIG. 1(*a*), is a basic embodiment in the case where the shape of a link member 10 forming a band 1 is substantially a square shape in a plan view. This shape of link member 10 will be called a "base block". As shown in FIG. 2, the present embodiment is a band 1 comprised of a plurality of link members 10 connected by pivot shafts to be able to pivot with respect to each other. Each link member 10 is comprised of a link member base part 11 in which a groove 11M is cut and a sheet member 12. The sheet member 12 is wrapped around the link member base part 11 in the length direction of the band 1. At the link member base part 11, the groove 11M around which the sheet member 12 is wrapped is formed at the inside in the width direction of the band so as to continue over the front and back surfaces of the band in the band length direction and is formed at the inside of the width direction of the band so as to continue in the vertical direction over the side parts between the front and back surfaces. The link member base part 11 is a wrapped member around which the sheet member 12 is wrapped. The sheet member 12 wrapped around the link member base part 11 in the present embodiment is a single strip, but may also be a plurality of strips aiming at an aesthetic effect.

The depth of the groove 11M is usually made about the thickness of the sheet member so as to make the top surface of the link member 10 a flat surface with no step difference between the link member base part 11 and the sheet member 12. However, it is also possible to make the top parts of the side surfaces of the sheet member 12 somewhat visible from the link member base part 11. Alternatively, the depth of the groove 11M may be made deeper than the thickness of the sheet member 12 so that the sheet member 12 cannot be seen from a side surface view. "Buried" is used in the sense including all of the above three embodiments. When using a precious metal for the sheet member 12, the part around which the sheet member 12 is wrapped appears to be solid precious metal, so the top parts of the side surfaces of the sheet member 12 are made to be seen. Note that, the groove 11M of the link member base part 11 may also be provided at just one of the top surface or bottom surface of the link member base part 11. Further, as explained later, a configuration is also possible in which the link member base part 11 is not provided with the groove 11M and in which the sheet member 12 covers the entire surface.

Each link member 10 is provided with through holes 5 in which pivot shafts 4 for connection with adjoining link member 10 to be able to pivot are inserted in the width direction of the band at two locations at the two sides in the length direction of the band. The pivot shafts 4, as shown in FIG. 2, are configured in the present embodiment formed into pivot members comprised of flat ring shapes, but the invention is not limited to this. They may also be formed into rectangular shapes in a plan view. Note that, if wrapping the sheet member in the length direction of the band 1, the folding axes at which the curved surfaces of the folded parts of the sheet member are formed, face the same width direction of the band as the through holes 5.

In the band 1, there is no need for all of the link members 10 to be configured comprised of a link member base part 11 around which a sheet member 12 is wrapped. It is sufficient that a sheet member 12 be wrapped around at least one link member base part 11. It is also possible to suitably select link members 10 having sheet members 12 in the band 1 so as to be skipped for aesthetic purposes. In the present invention, the members connected by the pivot shafts 4 to form the band are link members. When using for the link member base parts 11 ones where sheet members 12 are wrapped and ones where they are not wrapped, both are link members of this band. Each link member base part 11 around which a sheet member 12 is wrapped has side parts 11*a*, 11*b* facing adjoining link members 10 (here, referred to as "side parts in the band length direction"). At least one end part in a sheet member 12 is arranged between the top end part 11*d* (end part of band length direction at groove 11M at front side of link member base part 11) in the thickness direction at the side part 11*a* of the link member base part 11 and the bottom end part 11*e* (end part of band length direction at groove 11M at back side of link member base part 11). As explained above, when the link member base part 11 is shaped without a groove 11M, the end parts in the band length direction of the top surface and bottom surface of the link member base part 11 around which the sheet member 12 is wrapped, are the top end part 11*d* and bottom end part 11*e*. Further, the end parts may also be arranged at the side part 11*b*. In the example of FIG. 1(*a*), the two end parts 12*a*, 12*b* of the sheet member 12 are arranged at the side part 11*a* of the link member base part 11, while the sheet member 12 is wrapped so as to cover four surfaces of the center part of the link member base part 11 (front and back surfaces and two side parts). Note that, a "side part of the link member base part 11" means a side surface between a top end part 11*d* and bottom end part 11*e* of the link member base part 11 in the thickness direction. (Further, the side parts 11*a*, 11*b* are side surfaces of the link member base part 11 in the state where the sheet member 12 is not wrapped. FIG. 1(*a*) is a view where the sheet member 12 is wrapped, so in the sense of showing the portion of the link member base part 11 at the inside of the sheet member 12, the side parts and their lead out lines are shown by broken lines. The same is true for other embodiments.)

The sheet member 12 is configured formed into a shape curved from the top surface or bottom surface side of the link member base part 11 to the side part 11*a* or 11*b* side and so as to continue until at least one end part of the sheet member 12. The end part of the sheet member 12 is arranged between the top end part and bottom end part in the state with the end face facing the bottom surface side or top surface side. In the example of FIG. 1(*a*), the sheet member 12 is formed in a shape curved from the top surface side and bottom surface side of the link member base part 11 to the side part 11*a* side and continues to the two end parts 12*a*, 12*b*. The two end parts 12*a*, 12*b* of the sheet member 12 are arranged between the top end part 11*d* and bottom end part 11*e* in the state where the end faces 12*t*, 12*u* face the bottom surface side or top surface side. These end parts 12*a*, 12*b* and end faces 12*t*, 12*u* may also be arranged facing each other.

The rest of the configuration of the end parts of the sheet member will be explained in detail later.

By arranging at least one end part of the sheet member 12 between the top end part and bottom end part at a side part of the link member base part 11 in the thickness direction, this bent end part faces the adjoining connected link member and becomes hard to see thanks to being concealed by the connected link members, so a beautiful appearance such as a solid member is obtained. Further, the seam of the sheet member (part where two end parts or one end part of sheet member are positioned) is at the side part, so snags and burrs of end parts of the sheet member wrapped around the link member do not scratch the skin of the arm etc. and the feeling against the skin is also good.

Furthermore, the surface treatment and surface finishing of the sheet member wrapped around the link member base part can be performed independently from the link member base part, so it is possible to pursue various design variations. Due to this, it is possible to greatly reduce the costs compared with the prior art. In the case of a solid type link, polishing just the center part of the link member to a mirror finish is difficult, but in the present embodiment, it is also possible to polish a separate sheet member 12 in advance to a mirror finish in a state extending straight before being wrapped, then wrap it. The processing and assembly work become much easier. Further, the processing able to be performed in the state where the sheet member 12 extends straight, is not limited to the polishing to a mirror finish. Various processing and surface treatment can be easily performed.

In this way, in a watch band or decorative band, it is necessary to create various design effects. Not only plating and etching, but also pebbling by shot blasting and hairlining may be performed at the link member base part 11 and sheet member 12 separately, so the processing can be easily performed. Due to this, the decorative effects of the link member base part 11 and sheet member 12 processed differently as separate members remarkably appear, so it is possible to increase the design-like beautiful appearance. Further, since the seam of a sheet member 12 is at the side part, it is possible to create a high luxury feel as a solid member. If performing a certain extent of preliminary shaping before fitting a sheet member 12 into a link member base part 11, the assembly can be streamlined. When etching the sheet member 12, a special design effect is obtained by making the surface treatment of the underlying link member base part 11 visible.

As shown as examples in FIGS. 1(*b*), (*c*), one or more letters 16, symbols or marks 17, patterns, or other indications or a beautiful design appearance may be given to the sheet member 12. In FIGS. 1(*b*), (*c*), these are raised in projecting shapes, but of course they may also be formed in recessed shapes. As the processing means, press-forming is performed to raise letters 16, symbols or marks 17, etc. in relief shapes. In the sheet member 12, unlike a solid member, press-forming can be easily performed. Not only press-forming, but also marking and designs are possible by stamping, engraving, etching, laser processing, etc. The processing processes can be performed by the sheet member alone before wrapping it around the underlying link member 11, so these can be performed quickly and easily.

It is learned that if in this way making the sheet member and link member separate members, it is possible to pursue various design variations. Of course, the link member base part 11 and sheet member 12 are not limited to stainless steel materials. Variations using titanium materials, plastic, and other materials are also possible. The points explained regarding the first embodiment are basically similarly true in the embodiments explained below.

Second Embodiment

Figure 3:
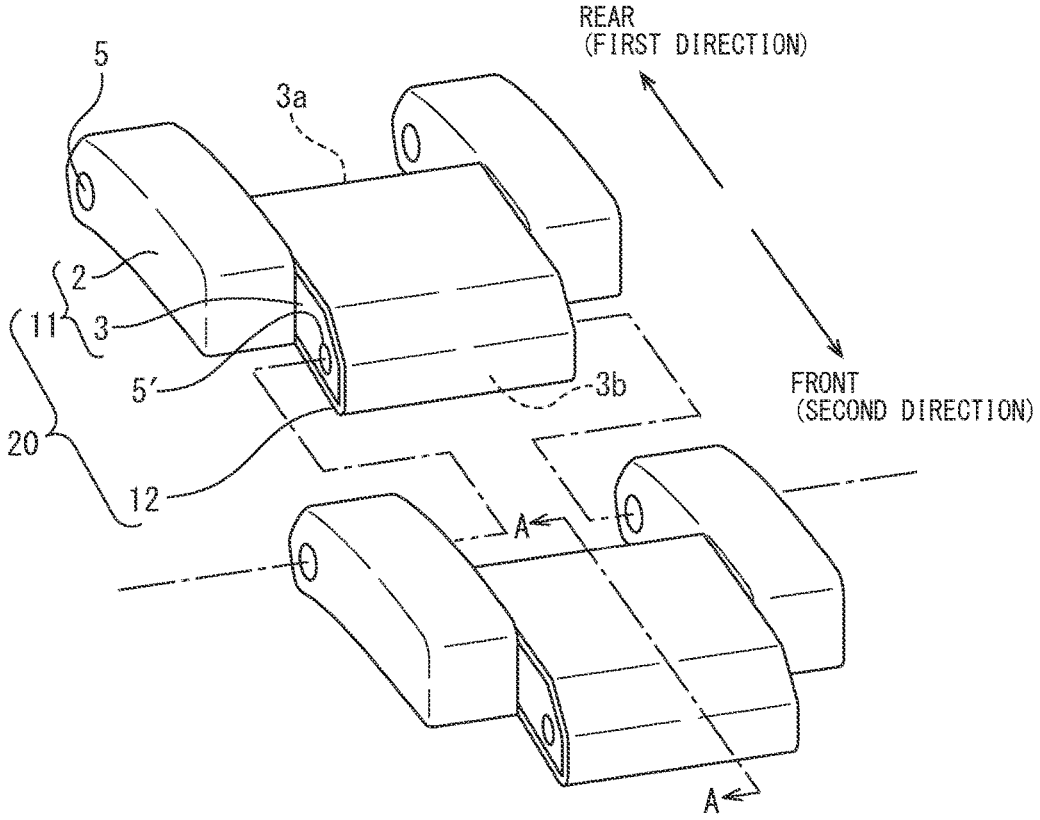
FIG. 3 is a perspective view showing a link member of a second embodiment of the present invention.
Figure 4:
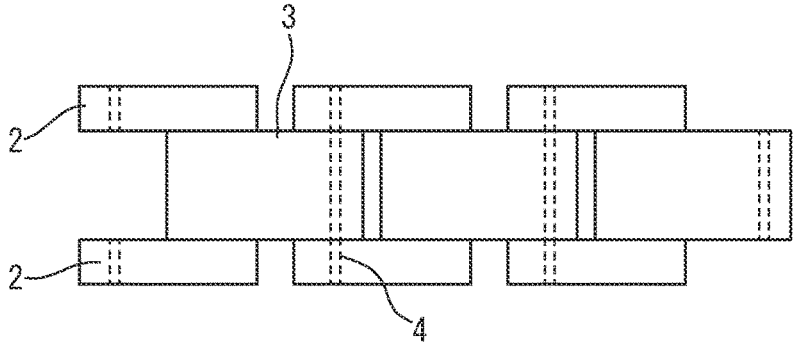
FIG. 4 is a plan view showing the second embodiment of the present invention.
Figure 5:
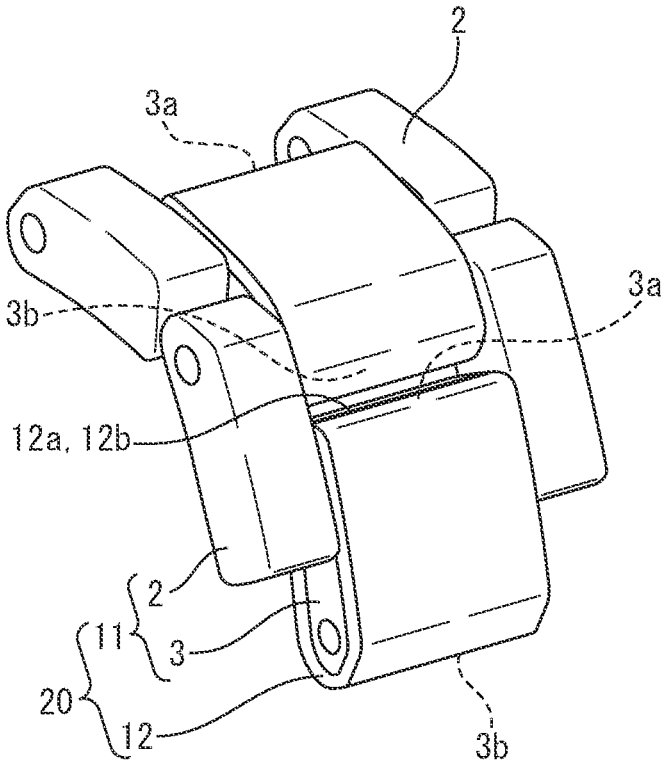
FIG. 5 is a perspective view showing connected link members of the second embodiment of the present invention.
Figure 6:
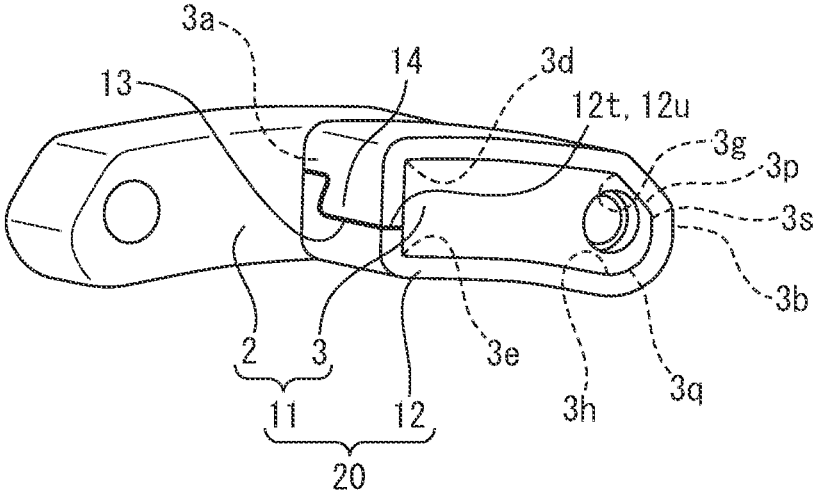
FIG. 6 is a cross-sectional perspective view along the line A-A of FIG. 3.
Figure 7:
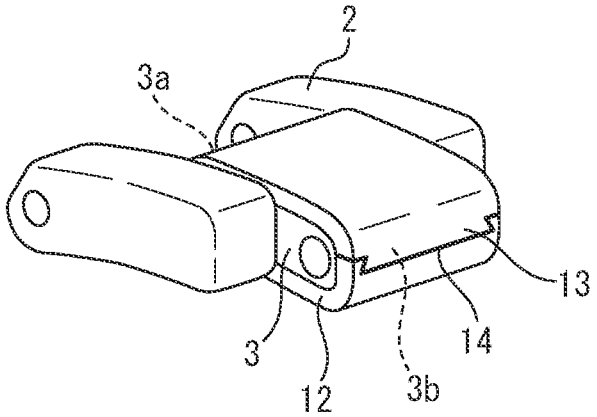
FIG. 7 is a perspective view showing a link member of the second embodiment of the present invention.

FIG. 3 is a perspective view showing a link member of a second embodiment of the present invention. FIG. 4 is a plan view showing the second embodiment of the present invention. FIG. 5 is a perspective view showing connected link members of the second embodiment of the present invention. FIG. 6 is a cross-sectional perspective view along the line A-A of FIG. 3. FIG. 7 is a perspective view showing a link member of the second embodiment of the present invention.

The second embodiment, as shown in FIGS. 3 and 4, is a band 1 comprised of a plurality of link members 20 connected by pivot shafts 4 to be able to pivot with respect to each other. The present embodiment is a band connecting link members 20 called "projecting shapes" with each other. The link members 20 are comprised of link member base parts 11 and sheet members 12. The link member base parts 11 around which the sheet members 12 are wrapped have middle link parts 3 and two outside link parts 2 straddling the middle link parts 3. The adjoining link members 20 are connected so that the middle link parts 3 are positioned at the insides of the band in the width direction and the outside link parts 2 are positioned at the outsides of the band in the width direction. The outside link parts 2 stick out from the middle link parts 3 along the length direction of the band. That is, as shown by the perspective view of FIG. 3, the middle link parts 3 stick out to the front and the outside link parts 2 at the two sides spring out to the rear. Such shapes of the link members 20 are not strictly speaking projecting shapes seen by a plan view, but will be called projecting shapes here. Further, in the present embodiment, the link member base part 11 is comprised of the outside link parts 2 and the middle link part 3 formed integrally. In the present embodiment, the above-mentioned front and rear directions in FIG. 3 mean the "front" and "rear" of the link member.

When the outside link parts 2 stick out to the rear (first direction) in the length direction of the band and the middle link part 3 sticks out to the front (second direction) from the outside link parts 2, the pivot shaft 4 is provided between the projecting parts at the pair of outside link parts 2. The respective middle link parts 3 are connected so as to adjoin each other in the length direction of the band. At each middle link part 3 forming a link member base part 11, a first side part 3*a* positioned at the rear and a second side part 3*b* positioned at the front are formed. At least one end part at the sheet member 12 is arranged at the first side part 3*a* of the middle link part 3, but it may also be arranged at the second side part 3*b*. FIG. 3, as shown in the later explained FIG. 6, shows an example where the first side part 3*a* of the middle link part 3 has the two end parts of the sheet member 12 arranged at it.

The sheet member 12 is wrapped in the length direction of the band around the middle link part 3 forming a part of the link member base part 11. Note that if wrapping the sheet member in the length direction of the band 1, the folding axes at which the curved surfaces of the folded parts of the sheet member, are formed face the same width direction of the band as the through holes 5, 5' at the time of connection. In the present embodiment, the sheet member 12 and middle link part 3 are the same in width, but the width of the sheet member 12 may also be made narrower than the width of the middle link part 3 (see later explained FIG. 10). A plural number of strips of sheet members 12 may also be provided.

In this case, at the middle link part 3, grooves around which the sheet member 12 is wrapped may be formed so as to continue along the band length direction over the front and back surfaces and to have the sheet members 12 buried in them (side surfaces also naturally have grooves). At the band 1, all of the link member base parts 11 do not have to have the sheet members 12 wrapped around them. It is sufficient that at least one has a sheet member 12 wrapped around it.

At each link member base part 11 in the width direction of the band, adjoining link members 20 and through holes 5, 5' through which pivot shafts 4 run, are provided. As shown in FIG. 3, through holes 5 are provided at the outside link parts 2, while the through hole 5' is provided at the middle link part 3. The pivot shaft member forming the pivot shaft 4 (connecting pin), as shown in FIG. 3, runs from the through hole 5 of an outside link part 2 through the through hole 5' of the middle link part 3 and exits from the through hole 5 of an outside link part 2. As shown in FIG. 4, in the present embodiment, a plurality of the same link members 20 are connected to form a band 1.

Figure 32:
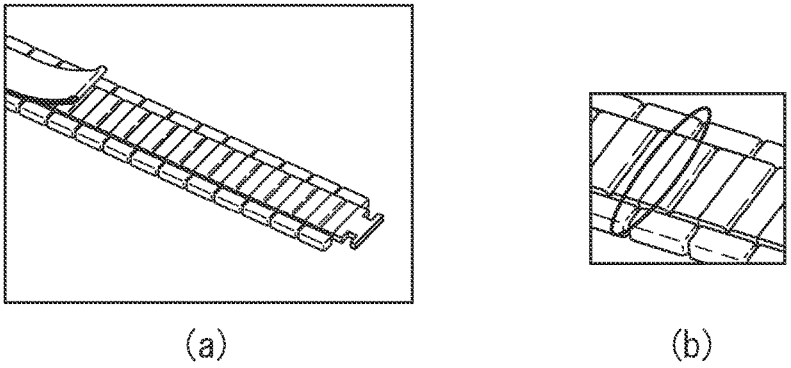
FIG. 32 PRIOR ART
FIG. 32(*a*) is a perspective view showing the prior art seen from the back side.
Figure 33:
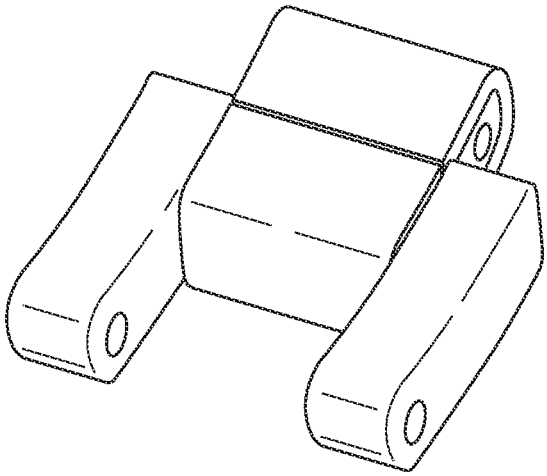
FIG. 33 PRIOR ART
FIG. 33 is a perspective view shows the prior art of the present invention.

If referring to the prior art of FIG. 32 and FIG. 33, the end parts of the sheet member wrapped around the link member base part are present at the back (under, bottom) surface of the link member and the seam of the sheet member is arranged at a readily visible position. A beautiful appearance like a solid member cannot be obtained and snags and burrs of the end parts scratch the skin of the arm. As opposed to this, as seen in FIG. 5, by arranging at least one end part at the sheet member 12 between the top end part 3*d* and bottom end part 3*e* in the thickness direction at a side part of the middle link part 3 forming the link member base part 11 (see FIG. 6), the seam of the sheet member wrapped around the link member base part is concealed by the connected link members and becomes harder to see. The middle link part 3 is therefore one giving a beautiful appearance like a solid member. Furthermore, the skin of the arm is never scratched. Furthermore, when the sheet member 12 and the middle link part 3 are the same in width, even if some sort of force acts in the width direction on a part near an end part of the sheet member 12, the vicinity of the end part abuts against the side part at the inside of an outside link part 2, so the end part of the sheet member 12 will not end up shifting in the width direction and detaching. FIG. 6 shows the case where the two end parts of the sheet member 12 are present as a seam at the side part 3*a* in the rear side (first direction) of the middle link part 3 of the link member 20. On the other hand, FIG. 7 shows the case where the two end parts of the sheet member 12 are present as a seam at the side part 3*b* in the front side (second direction) of the middle link part 3 forming the link member base part 11. Further, the front-side side part 3*b* shown in FIG. 6 and FIG. 7 has a vertical surface 3*s* and further has a slanted surface 3*p* or curved surface 3*q* positioned between this vertical surface 3*s* and top surface or bottom surface of the middle link part 3. In such a case, the end part 3*g* at the top surface side at the slanted surface 3*p* and the end part 3*h* at the bottom surface side at the curved surface 3*q* are respectively the top end part and bottom end part at the side part 3*b*. The same is true in the case where 3*p* is the curved surface while 3*q* is the slanted surface. For example, when arranging end parts of the sheet member 12 at the slanted surface 3*p*, compared with when arranging end parts of the sheet member at the bottom surface of the link member base part like in the prior art of FIG. 32 and FIG. 33, there are the effects that it becomes harder for the end parts of the sheet member to be seen and it becomes harder for snags and burrs of the end parts to scratch the skin of the arm. End parts of the sheet member 12 arranged at a part slanted such as the slanted surface 3*p* usually are visible only from the slanted direction. Further, this is because they are positioned at the recessed parts rather than the top surface. However, the end parts of the sheet member 12 are preferably arranged at the vertical surface 3*s* since the above-mentioned effect is large. Further, when arranging the end parts of the sheet member 12 at the slanted surfaces 3*p* and curved surfaces 3*q*, arranging them at positions closer to the vertical surface 3*s* than the top surface and bottom surface of the middle link part 3 is preferable since the above-mentioned effects are larger. As shown in FIG. 6, by arranging the end part of the sheet member 12 at the side part 3*a* retracted in the band length direction at the middle link member 3, even if viewing this part from the side part in the width direction of the band, it is concealed by the outside link part 2 and not visible. Further, as shown in FIG. 7, by arranging the end parts of the sheet member 12 at the side part 3*b* sticking out at the middle link part 3 in the band length direction, compared with the case shown in FIG. 6, the sheet member 12 becomes easier to wrap and the assembly ability is improved.

When the front side of the middle link part 3 of the link member 20 faces the mounting part of the watch case, in the case where there is a seam formed by the two end parts of the sheet member 12 in the rear side (first direction) of the middle link part 3 of FIG. 6, when the watch is worn, the seam is positioned at the opposite side of the watch case at the individual link members 20 and, when viewing the hands or dial plate, the seam becomes inside a dead angle and becomes difficult to see. Further, in this case, as shown in FIG. 5, even in the state where the link members 20 are pivoted by about 30°, the side part 3*a* of the rear side (first direction) at the middle link part 3 (the front side middle link part 3) of the front side shown in FIG. 5 is concealed by the facing part from the side part 3*b* to the back surface at the front side (second direction) of the rear side middle link part 3. Furthermore, the connecting structure is one where the link members 20 can pivot by an angle of about 30° or more. Even if pivoting from the state of FIG. 5 by an angle of 30° or more, the side part 3*a* of the rear side (first direction) at the middle link part 3 of the front side shown in FIG. 5 is concealed by the facing back surface at the front side (second direction) of the rear side middle link part 3. Therefore, by arranging the end parts 12*a*, 12*b* at the sheet member 12 at the side part 3*a* at the rear side (first direction) at the middle link part 3, regardless of the pivot angle between the link members, the end parts 12*a*, 12*b* are concealed by the adjoining link members. This is due to the fact that the rear side middle link part 3 is shaped sticking out more to the side part 3*a* of the front side middle link part 3 than the pivot shaft connecting the front side middle link part 3 and the rear side middle link part 3 (in this case, projecting shape). In this way, there are side parts harder to see depending on the direction of attachment of the band to the watch case or the link shapes, but whether to provide a seam at the front side of the middle link part 3 or provide a seam at the rear side of the middle link part 3 can be suitably determined in accordance with the state of connection of the plurality of links. The position of a seam is suitably set by the method of wrapping the sheet member 12 around the link member base part 11, but the point is that it should be set at a location where it is hard to see from the back or front due to the connected adjoining link member 20, outside link part 2, etc. and a position not scratching the skin of the arm. The position of the seam of the sheet member satisfying such conditions is between the top end part and bottom end part at the side part 3*a* or 3*b* of the link member base part.

Regarding the relationship between the state of connection of the plurality of links and the state of visibility of the seam, the following results were obtained as result of research and development up to now. It is learned that when the link member 20 is a projecting shape and the end parts of the sheet member 12 are positioned at the side part 3*a* at the rear side of the middle link part 3, if the thickness of each link member, including the thickness of the sheet member 12, is 3 mm to 5 mm or so in range and, at the time of connection, the gap between the surface of the sheet member 12 wrapped around the middle link part and the surface of the sheet member 12 wrapped around the adjoining middle link part 3 is generally made 2 mm or less, even if viewed from a slant in the pivoted state such as in FIG. 5, the rear side middle link part 3 would obstruct viewing of the end parts of the sheet member 12 wrapped around the front side middle link part 3 and therefore the seam can no longer be easily seen.

The sheet member 12 is configured to be formed into a shape bent from the top surface or bottom surface side of the link member base part 11 to a side part side and continue to at least one end part of the sheet member 12. The end parts of the sheet member 12 are arranged between the top end part and bottom end part of a side part of the middle link part 3 in a state with the end faces facing the bottom surface side or top surface side. In the example of FIG. 6, the sheet member 12 is formed into a shape bent from the top surface side and a side surface side of the link member base part 11 to the side part 3*a* side and continues up to the two end parts 12*a*, 12*b*. The end parts 12*a*, 12*b* of the sheet member 12 are arranged between the top end part 3*d* and bottom end part 3*e* in a state with their end faces 12*t*, 12*u* facing the bottom surface side or top surface side. These end parts 12*a*, 12*b* and end faces 12*t*, 12*u* may be arranged facing each other as well. Next, the method of wrapping the sheet member 12 around the link member base part 11 will be explained in detail. Further, the end faces 12*t*, 12*u* are shown in FIG. 8(*a*) as well used in the later explanation so as to facilitate understanding of the portions formed at the sheet member 12.

Figure 8:
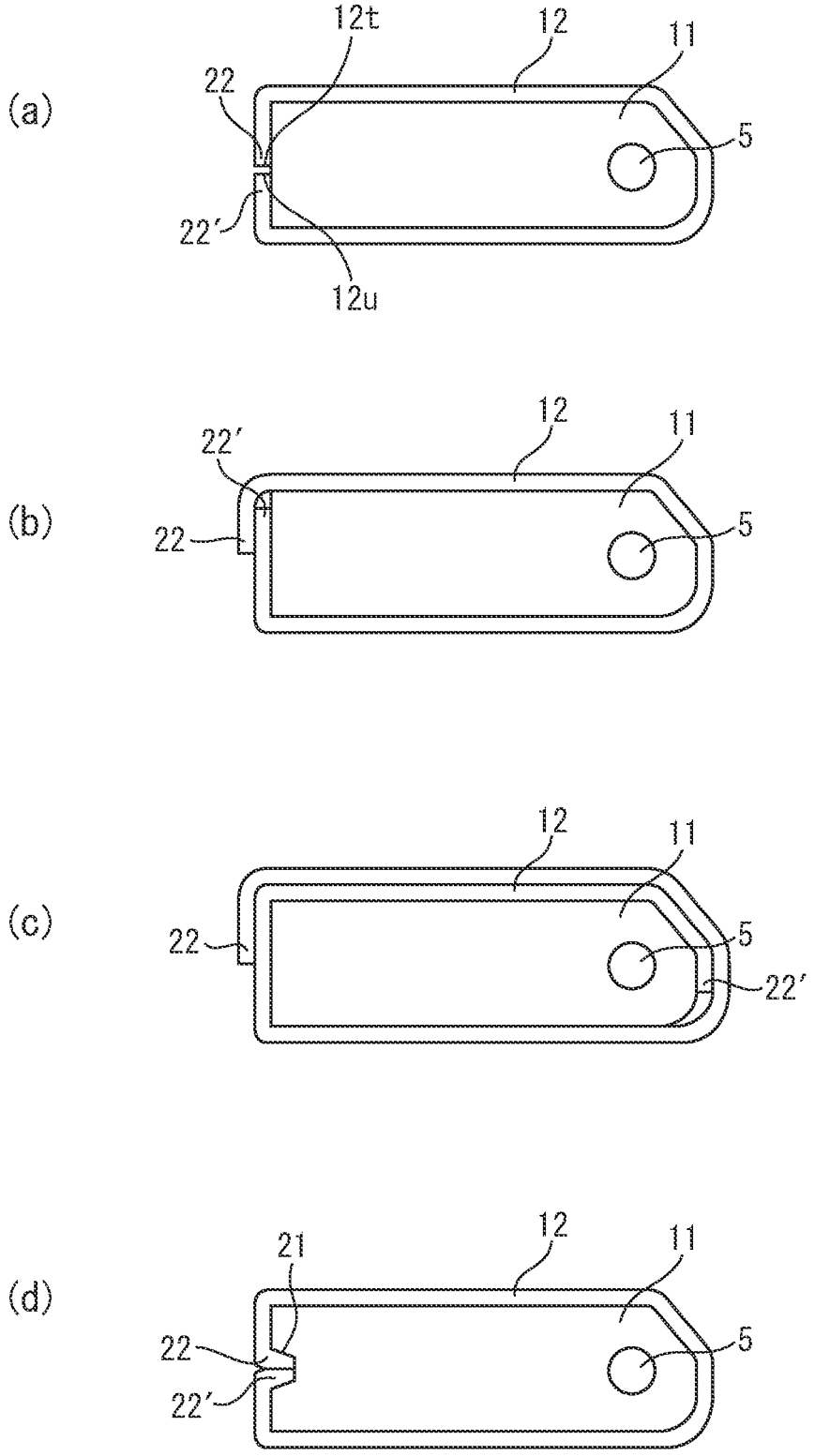
FIGS. 8(*a*) to (*d*) are cross-sectional views along the line A-A of FIG. 3.
Figure 9:
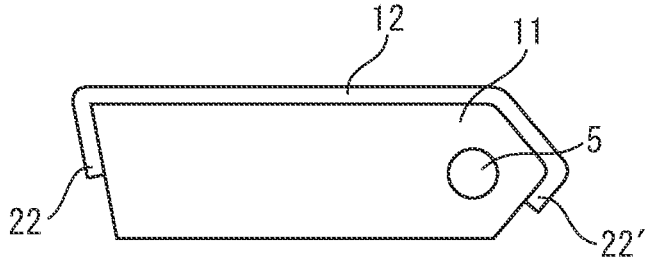
FIGS. 9(*e*) to (*h*) respectively are cross-sectional views along the line A-A of FIG. 3.
Figure 9:
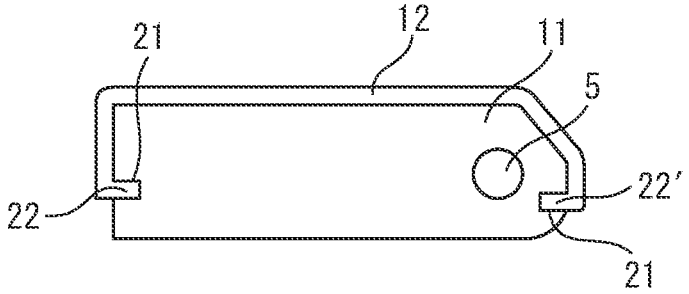
Figure 9:
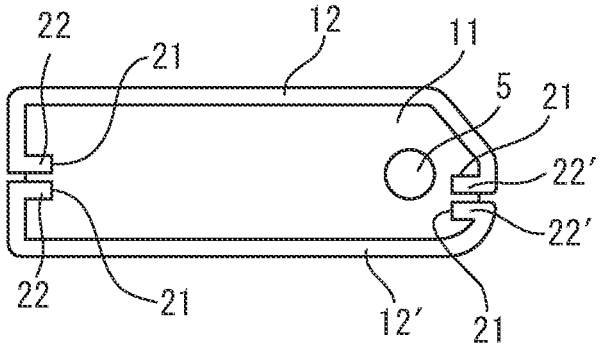
Figure 9:
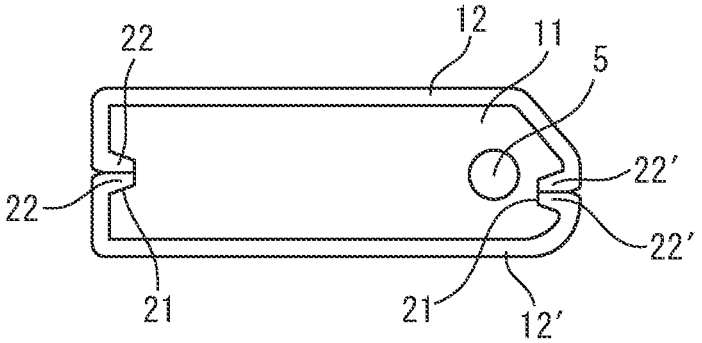

FIGS. 8(*a*) to (*d*) are cross-sectional views along the line A-A of FIG. 3. FIGS. 9(*e*) to (*h*) respectively are cross-sectional views along the line A-A of FIG. 3.

Next, there are various methods of wrapping the sheet member 12 around the link member base part 11 in the length direction of the band 1 as shown in FIGS. 8, 9(*a*) to (*h*). Of course, the wrapping methods are not limited to just these. Further, the link member base part 11 may be one of the shape of the first embodiment, one comprised of a middle link part 3 and outside link parts 2 such as in the second embodiment, and ones of the shapes of the later explained third embodiment and on, but the explanation here can also be applied to parts of the shapes in other embodiments. What is illustrated in this explanation is the middle link part 3 forming part of the link member base part 11 at the second embodiment. Reference numeral 11 is used.

FIG. 8(*a*) shows the method of wrapping the sheet member 12 around the link member base part 11 in the case of arranging the two end parts 22, 22' of the sheet member 12 between the top end part and bottom end part of a side part in the thickness direction. The engagement part of the sheet member 12 will be explained later in FIG. 16. Here, the two end parts 22, 22' of the sheet member 12 are respectively straight shapes. This is the case of no engagement parts as explained later.

FIGS. 8(*b*), (*c*) show the method of wrapping the sheet member 12 around the link member base part 11 when arranging at least one end part 22 of the sheet member 12 between the top end part and bottom end part of the side part in the thickness direction. In the case of FIG. 8(*b*), one end part 22 and the other end part 22' overlap, the other end part 22' is concealed at the inside of the sheet member 12, and both are present at one side part. In the case of FIG. 8(*c*), one end part 22 is exposed at the outside of the sheet member 12, but the other end part 22' is arranged at the other side part and is concealed at the inside of the sheet member 12 covering this part. At least one end part 22 at the sheet member 12 is arranged between the top end part and bottom end part at the side part in the thickness direction, but as shown in FIGS. 8(*b*), (*c*), the other end part 22' is concealed at the inside of the sheet member 12 and is made unable to be seen. The other end part 22' is not limited to these embodiments. It is sufficient that it not be able to be seen or is arranged at a position where it is hard to see.

FIG. 8(*d*) shows the case where the two end parts 22, 22' of the sheet member 12 are arranged between the top end part and bottom end part at one side part in the thickness direction in which the two end parts 22, 22' of the sheet member 12 (with insides cut to slanted surfaces) are buried in trapezoidal cross-section grooves 21 at the side part. The insides of the two end parts are cut to slanted surfaces whereby when pushed in by a wedge action (press-fit), close bonding of the two end parts 22, 22' becomes easy and the two end parts become hard to detach. FIG. 9(*e*) shows the case where the end parts 22, 22' of the sheet member 12 are covered so as not to deviate from the slanted surfaces of one side part and the other side part. FIG. 9(*f*) shows the case where the end parts 22, 22' of the sheet member 12 are inserted into the grooves 21, 21 of one side part and the grooves 21, 21 of the other side part.

FIG. 9(*g*) shows the case where the two top and bottom sheet members 12, 12' cover the link member base part 11 from the top and bottom and where the respective end parts 22, 22' are made to face each other and are inserted into the grooves 21, 21 of one side part and the other side part. FIG. 9(*h*) shows the case where at the two top and bottom sheet members 12, 12', the end parts 22, 22' are press-fit from above and below the link member base part 11 into the trapezoidal cross-section grooves 21, 21 of one side part and the other side part in the same way as FIG. 8(*d*). Note that, in FIGS. 9(*g*), (*h*), the top sheet member covering the front side is defined as the "first sheet member 12" and the bottom sheet member covering the back side is defined as the "second sheet member 12'".

In FIGS. 9(*g*), (*h*), the end part of the first sheet member 12 and the end part of the second sheet member 12' face each other forming L-shapes since the end parts 22, 22' are inserted into the groove 21 of the link member base part 11 at the side parts. The end part of the first sheet member 12 and the end part of the second sheet member 12' may also be straight if connecting each other by bonding or welding. Note that it is also possible to directly fasten the end part of the sheet member 12 to the link member base part 11 by bonding or welding.

FIGS. 10 to 15 are perspective views showing various methods of wrapping a sheet member 12 in a link member of a second embodiment of the present invention. The symbols and lead lines of the side parts, top end parts, bottom end parts, grooves, etc. are shown in only FIG. 10 where explanations are required. To prevent the figures from becoming complicated, they are suitably omitted in FIGS. 10 to 12, FIG. 14, and FIG. 15.

Figure 11:
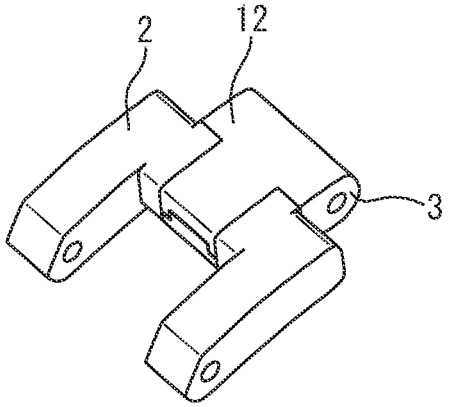
FIG. 11 is a perspective view showing a link member of the second embodiment of the present invention.
Figure 12:
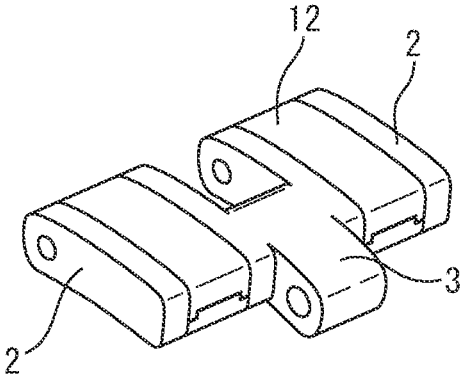
FIG. 12 is a perspective view showing a link member of the second embodiment of the present invention.

The sheet member 12 can be wrapped around the middle link part 3 or outside link parts 2 in the length direction, width direction, or both directions of the band. The "side parts" at the present invention are not necessarily just arranged at the length direction of the band. The embodiment of FIG. 10, unlike the case of FIG. 3 where the sheet member 12 and middle link part 3 are the same in width, is an embodiment in the case where the sheet member 12 is wrapped around the middle link part 3 shorter than the entire width of the middle link part 3 in the width direction of the band. The embodiment of FIG. 11 is a type halfway between FIG. 3 and FIG. 10. In this embodiment, the sheet member 12 is wrapped around the middle link part 3 by shorter than the entire width of the middle link part 3 in the width direction of the band at part of the middle link part 3. At the other parts of the middle link part 3, the sheet member 12 and the middle link part 3 are made the same in width. In the example illustrated in FIG. 11, the length of the sheet member 12 in the width direction of the band is short at the part where the middle link part 3 does not stick out from the outside link part 2 and is long at the part where the middle link part 3 sticks out from the outside link parts 2 in the length direction of the band. The embodiment of FIG. 12 is an embodiment in which the sheet member 12 is not wrapped around the middle link part 3 but is wrapped around both or one of the outside link parts 2 in the length direction of the band. Of course, the sheet member 12 may also be wrapped around both of the outside link parts 2 and the middle link part 3.

Figure 13:
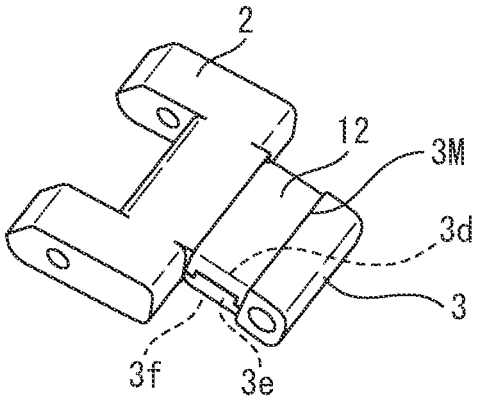
FIG. 13 is a perspective view showing a link member of the second embodiment of the present invention.
Figure 14:
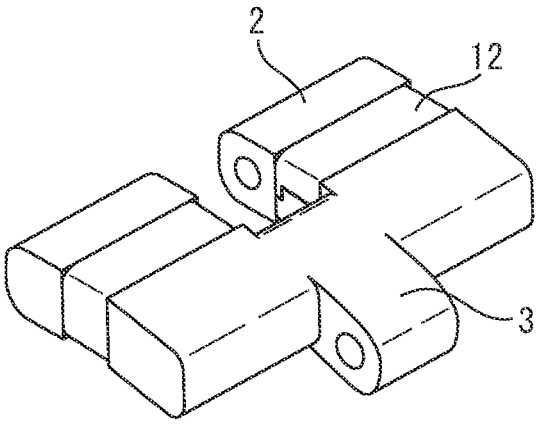
FIG. 14 is a perspective view showing a link member of the second embodiment of the present invention.
Figure 15:
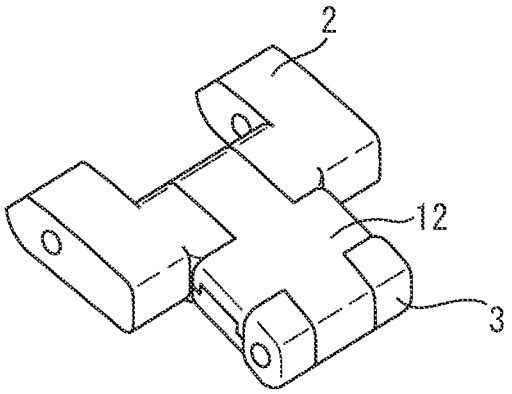
FIG. 15 is a perspective view showing a link member of the second embodiment of the present invention.

The embodiment of FIG. 13 is an embodiment in the case where the middle link part 3 is wrapped around by the sheet member 12 in the width direction of the band. In the example illustrated in FIG. 13, the sheet member 12 is wrapped around a groove 3M formed in the band width direction of the part where the middle link part 3 sticks out from the outside link parts 2 in the length direction of the band. The two end parts of the sheet member 12 are arranged at the side part 3*f* of the middle link part 3 in the width direction. When wrapping the sheet member 12 around the middle link part 3 in the band width direction in this way, to wrap the sheet member 12, the end parts in the width direction at the groove 3M formed at the front side and back side of the link member base part 11 are the top end part 3*d* and bottom end part 3*e* of the link member base part 11. Further, in the case of a shape where the middle link part 3 does not have a groove 3M, the end parts of the top surface and bottom surface of the middle link part 3 in the band width direction where the sheet member 12 is wrapped are the top end part 3*d* and bottom end part 3*e*. The positions of the top end part and bottom end part are similar to the case of the outside link parts. The embodiment of FIG. 14, unlike the case of FIG. 13, is an embodiment where a sheet member 12 is wrapped around both or one of the outside link parts 2 in the width direction of the band. In the example shown in FIG. 14, a sheet member 12 is wrapped around a part where an outside link part 2 sticks out from the middle link part 3 in the length direction of the band. The embodiment of FIG. 15 is an embodiment in which the sheet member 12 is wrapped around the middle link part 3 in both the length direction of the band and the width direction of the band in a cross shape. The sheet member 12 is formed into a cross shape. Note that, the outside link parts 2 may also be wrapped by cross-shaped sheet members. In the example of FIG. 15, the middle link part 3 is a part sticking out from the outside link parts 2 in the length direction of the band. The sheet member 12 is wrapped around it in the width direction of the band. In the case of FIGS. 13 to 15, the seam of a sheet member wrapped around the link member is arranged at a position hard to see thanks to the connected link members. That is, in the case of the embodiment of FIG. 13, the end parts of the sheet member 12 face the side part at the inside in the band width direction at an outside link part 2 of the connected adjoining link member, so the seam of the sheet member is concealed. Further, in the case of the embodiment of FIG. 14, the end parts of the sheet member 12 face a side part at the outside in the band width direction at the middle link part 3 of the connected adjoining link member, so the seam of the sheet member is concealed. The end parts of the sheet member 12 in the length direction of the band in the case of FIG. 15, in the same way as the second embodiment, are arranged at the rear and concealed by the middle link part 3 of the connected adjoining link member. The end parts of the sheet member 12 in the width direction of the band, in the same way as the embodiment of FIG. 13, are arranged at the front and concealed by an outside link part 2 of the connected adjoining link member. In the case of FIG. 13 to FIG. 15, by limiting the pivoting range of the adjoining link members 20 with each other, even if viewing the band from the side parts in the band width direction, the end parts of the sheet members 12 are constantly concealed by the outside link parts 3 or middle link parts 2 adjoining them and become hard to see. Furthermore, in the case of FIG. 15, compared with directly decorating the surface of the link member base part 11, it is possible to easily provide a complicated decoration such as a cross shape. Further, as shown in FIG. 12, when wrapping sheet members 12 around the outside link parts 2 in the length direction of the band, the end parts of the sheet members 12 are preferably arranged at the side parts where the outside link parts 2 do not stick out from the middle link part 3 in the length direction of the band. In this case, the outside link parts of the link member connected to the front side in FIG. 12 stick out to the seam side further than the pivot shaft passing through the through holes of the middle link part 3 shown in FIG. 12. Due to this, in the same way as the case explained in FIG. 5, some part from the side parts of the sticking out adjoining outside link parts to the back surface becomes a state facing the seam. Therefore, regardless of the pivoting state of the link members, the seam of the sheet member 12 is concealed.

Figure 16:
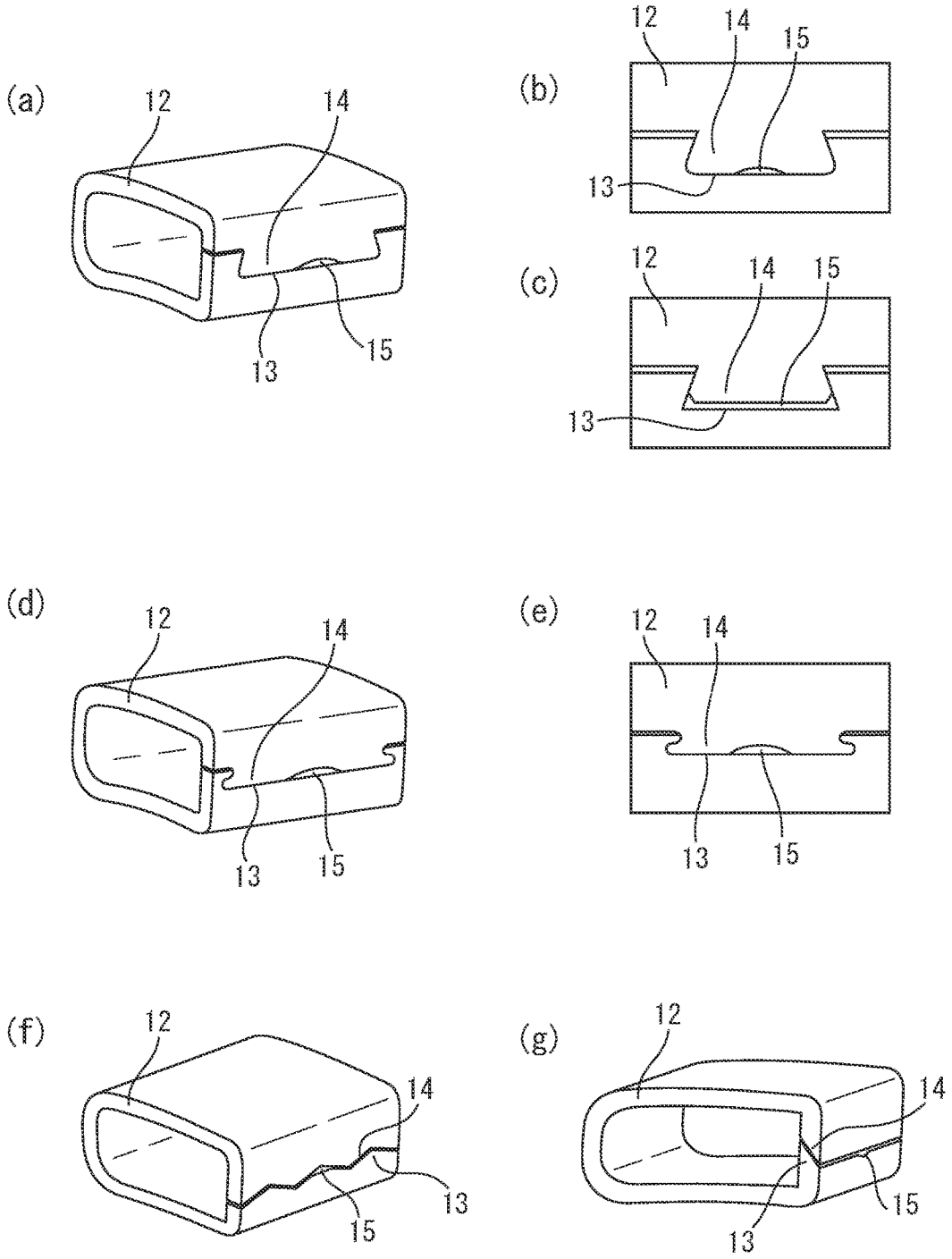
FIG. 16(*a*) is a perspective view showing engagement parts of a sheet member. (*b*) and (*c*) are front views showing engagement parts of the sheet members. (*d*) is a perspective view showing engagement parts of the sheet member. (*e*) is a front view showing engagement parts of the sheet member. (*f*) and (*g*) are perspective views showing engagement parts of the sheet members.

FIG. 16(*a*) is a perspective view showing engagement parts of a sheet member. (b) and (c) are front views showing engagement parts of the sheet members. (d) is a perspective view showing engagement parts of the sheet member. (e) is a front view showing engagement parts of the sheet member. (f) and (g) are perspective views showing engagement parts of the sheet members. These figures are perspective views of only the sheet member 12. Illustration of the link member base part 11 is omitted.

FIG. 16(*a*) shows a case of making the two end parts of the sheet member 12 between the top end part and bottom end part of the side part of the link member base part (not shown) in the thickness direction engage with each other by wedge shape engagement parts 13, 14 to try to prevent separation of the link member 20 in the thickness direction. If possible to prevent separation in the thickness direction, the engagement parts formed at the two end parts of the sheet member may be any engageable shapes without the two end parts overlapping each other. In FIG. 16(*a*), wedge shapes of FIG. 16(*b*) are employed. The sheet member 12 is bent from the straight state to the shape shown in FIG. 16 and wrapped around the link member base part 11, then usually spring back occurs at the sheet member 12 and the seam of the two end parts rises. If making the two end parts of the sheet member 12 engage with each other by wedge shape engagement parts 13, 14, it is possible to prevent rising due to such spring back. Further, in the case of the wedge shapes, even if tension or twisting occurs which would cause the two end parts of the sheet member 12 to separate, due to the wedge action, no separation will occur.

In the state where the two end parts of the sheet member are engaged with each other by the engagement parts 13, 14, a gap part 15 is formed at one (or both) of the two end parts. If wrapping the sheet member 12 around the link member base part 11, then scratching or otherwise damaging the mirror finished or otherwise processed surface of the sheet member 12, a need arises to detach and replace the sheet member 12 or take other corrective action. A gap part 15 is provided for prying apart the engagement parts 13, 14 from the a gap part 15 to remove the sheet member 12 from the link member base part 11. Here, the gap part is formed as an arc, but the invention is not necessarily limited to this. As shown in FIG. 16(*c*), the straight two end parts of the engagement parts 13, 14 may also be separated from each other to form a gap part 15. Further, if forming slanted surfaces at the backs of the two end parts of the sheet member 12 to enable the insertion of the front end of a spatula etc. between the side part of the link member base part 11 and slanted surfaces, it becomes easy to pry apart the engagement parts 13, 14, so this is advantageous.

In the case of FIG. 16(*d*), as shown in FIG. 16(*e*), the engagement parts 13, 14 are formed into interlocking puzzle-like shapes. Parts of the two end parts of the sheet member 12 are formed with a gap part 15. The engagement parts 13, 14 may also be formed into key shapes. Even when the engagement parts of the sheet member 12 are made such shapes, not only is it possible to prevent the two ends from rising from the link member base part 11 due to spring back, but also it is possible to simultaneously prevent rising due to twisting or tension. In the case of FIG. 16(*f*), the engagement parts 13, 14 are formed into wavy shapes. The engagement parts 13, 14 are formed into shapes not engaging in the thickness direction of the band, but engaging in the width direction. Therefore, in this case, it is possible to prevent deviation of the two ends in the band width direction. The two end parts of the sheet member 12 are fastened together by bonding etc. or are fastened to the link member base part 11. In this case as well, a gap part 15 is formed at part of the two end parts. A spatula etc. is inserted here and the binder is peeled off etc. to pry apart the engagement parts 13, 14. In the case of FIG. 16(*g*), the two end faces of the engagement parts 13, 14 are formed by slanted surfaces. In this case, the engagement parts 13, 14 are not engaged in the thickness direction and width direction of the band. The slanted surface of the engagement part 14 pushes the slanted surface of the engagement part 13 to the link member base part 11 side to engage it so as not to stick out to the adjoining link member. In the same way as the case of FIG. 16(*f*), the two end parts of the sheet member 12*s* are fastened by bonding etc. and are designed to have the binder peeled off and be pried apart by formation of a gap part 15 at part of the two end parts. Furthermore, the slanted surface facing the inside direction of the engagement part 14 can be hooked by the front end part of a spatula etc., so is effective when prying apart the engagement parts 13, 14.

When the link member base part 11 has the sheet member 12 wrapped around it and fastened, if the two end parts of the sheet member 12 are not formed into engaging shapes, press-fitting, vacuum contact, bonding, swaging, magnetic bonding, screwing, etc. can be employed. Further, the two end parts of the sheet member 12 can also be welded together by laser etc. In the case of FIGS. 8 and 9(*a*) to (*h*) or in the case such as in FIGS. 16(*a*) to (*g*) where the sheet member 12 is wrapped around the link member base part 11, it is possible to form the parts in advance into shapes facilitating wrapping of the sheet member 12. Due to this, the processing process for wrapping the sheet member 12 can be performed extremely simply. The engagement parts 13, 14 shown in FIGS. 16(*a*) to (*e*) can also be formed into shapes reversing the male/female relationship. In the examples shown in FIGS. 16(*a*) to (*e*), the engagement part 14 arranged at the top side of the link member base part 11 in the thickness direction is a projecting shape, while the engagement part 13 arranged at the bottom side of the link member base part 11 in the thickness direction is a recessed shape. When the engagement parts 13, 14 are formed into shapes reversing the male/female relationship, the engagement part 14 arranged at the top side of the link member base part 11 in the thickness direction is a recessed shape, while the engagement part 13 arranged at the bottom side of the link member base part 11 in the thickness direction is a projecting shape. In the engagement part 14 formed in a projecting shape shown in FIGS. 16(*a*) to (*e*), the length of the part sticking out to the bottom surface side in the width direction of the link member base part 11 is longer than the length of the part not sticking out at the left side or right side. In the case of this shape, the center part of the seam becomes longer. This becomes positioned close to the bottom surface at the link member base part 11. As opposed to this, when forming the engagement parts 13, 14 shown in FIGS. 16(*a*) to (*e*) into shapes with the reverse male/female relationship, the center part of the seam where the length becomes long becomes a position close to the top surface side at the link member base part 11. Therefore, as shown in FIGS. 16(*a*) to (*e*), by forming the engagement part 14 and the engagement part 13 into respectively a projecting shape and recessed shape, compared with when forming them in reverse shapes from this, the seam can be made to no longer stand out.

Figure 17:
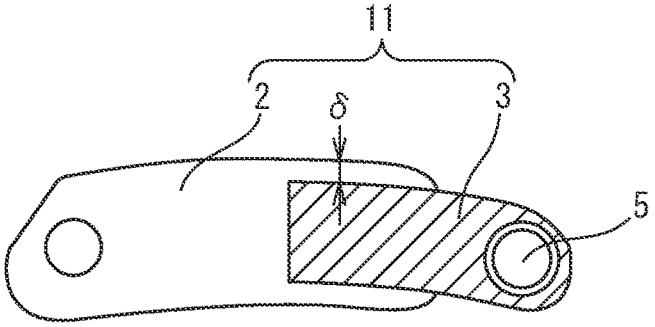
FIG. 17 is a cross-sectional view along the line A-A of FIG. 3.
Figure 18:
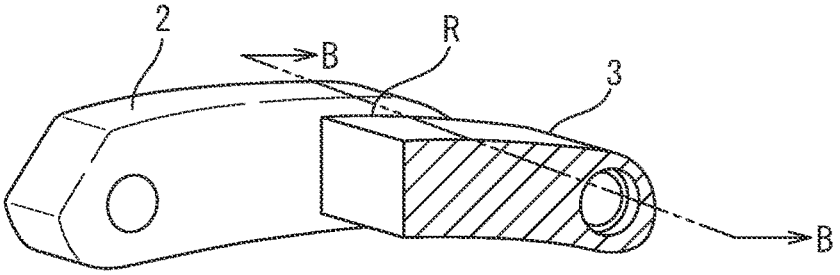
FIG. 18 is a cross-sectional perspective view along the line A-A of FIG. 3.
Figure 19:
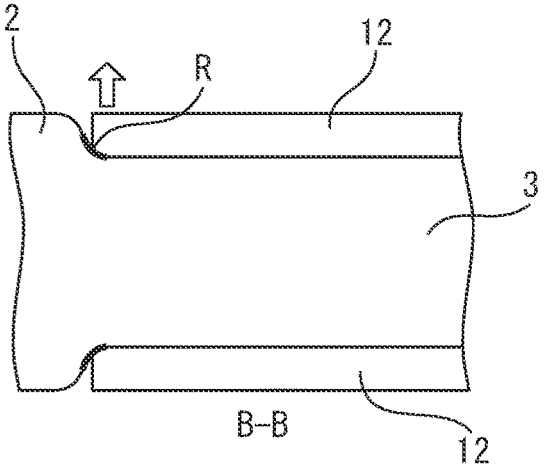
FIG. 19 is a partial cross-sectional view along the line B-B of FIG. 18.
Figure 20:
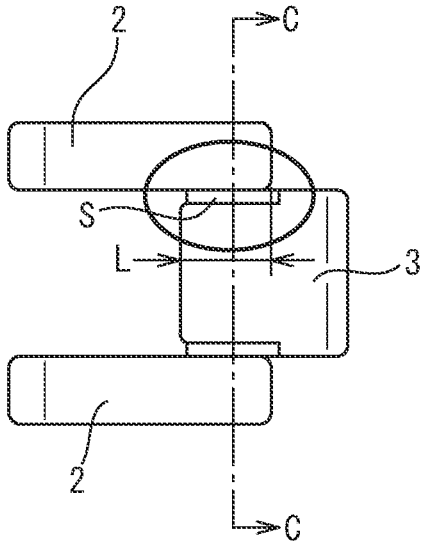
FIG. 20 is a plan view showing a base part of a link member of the second embodiment of the present invention.
Figure 21:
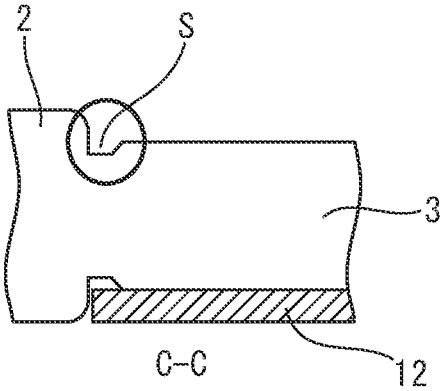
FIG. 21 is a partial cross-sectional view along the line C-C of FIG. 20.

FIG. 17 is a cross-sectional view along the line A-A of FIG. 3. FIG. 18 is a cross-sectional perspective view along the line A-A of FIG. 3. FIG. 19 is a partial cross-sectional view along the line B-B of FIG. 18. FIG. 20 is a plan view showing a base part of a link member of the second embodiment of the present invention. FIG. 21 is a partial cross-sectional view along the line C-C of FIG. 20.

FIG. 17 shows the step difference δ formed at the link member base part 11 by an outside link part 2 and the middle link part 3. The depth of the step difference δ is usually made the extent of thickness of the sheet member 12 so that the top surface of the link member 20 is made a flat shape with no step difference between the link member base part 11 and the sheet member 12. However, the top parts of the side surfaces of the sheet member 12 may be somewhat visible from the link member base part 11. Alternatively, the step difference δ may be made deeper than the thickness of the sheet member 12 to prevent the top parts of the side surfaces of the sheet member 12 from being visible by a side surface view. When using a precious metal for the sheet member 12, to make the part around which the sheet member 12 is wrapped appear to be solid precious metal, sometimes the top parts of the side surfaces of the sheet member 12 are visible. Whatever the case, it is sufficient that just the bottom surface of the sheet member 12 cannot be seen by a side surface view.

Usually, if producing the link member base part 11 comprised of the outside link parts 2 and middle link part 3 integrally formed by press-forming and forging, the boundary R between the outside link parts 2 and the middle link part 3 end up formed with a rounded angular part R (so-called "R part"). For this reason, the angular parts of the bottom surface of the sheet member 12 etc. sometimes struck this R part and turned upward in the arrow direction of the FIG. 19 thereby detracting from the finish of the boundary.

To prevent such a problem in turn up, a groove S is formed along the boundary between the outside link parts 2 and the middle link part 3 at both the front and back surfaces of the middle link part 3. The groove S, seen from the side surface of the band, preferably has length of an extent concealed by the outside link parts 2. Due to this, as shown in FIG. 21, due to the groove S, the angular parts of the bottom surface of the sheet member 12 etc. no longer strikes the boundary between the outside link part 2 and the middle link part and will not be turned upward as shown in FIG. 19.

Third Embodiment

Figure 22:
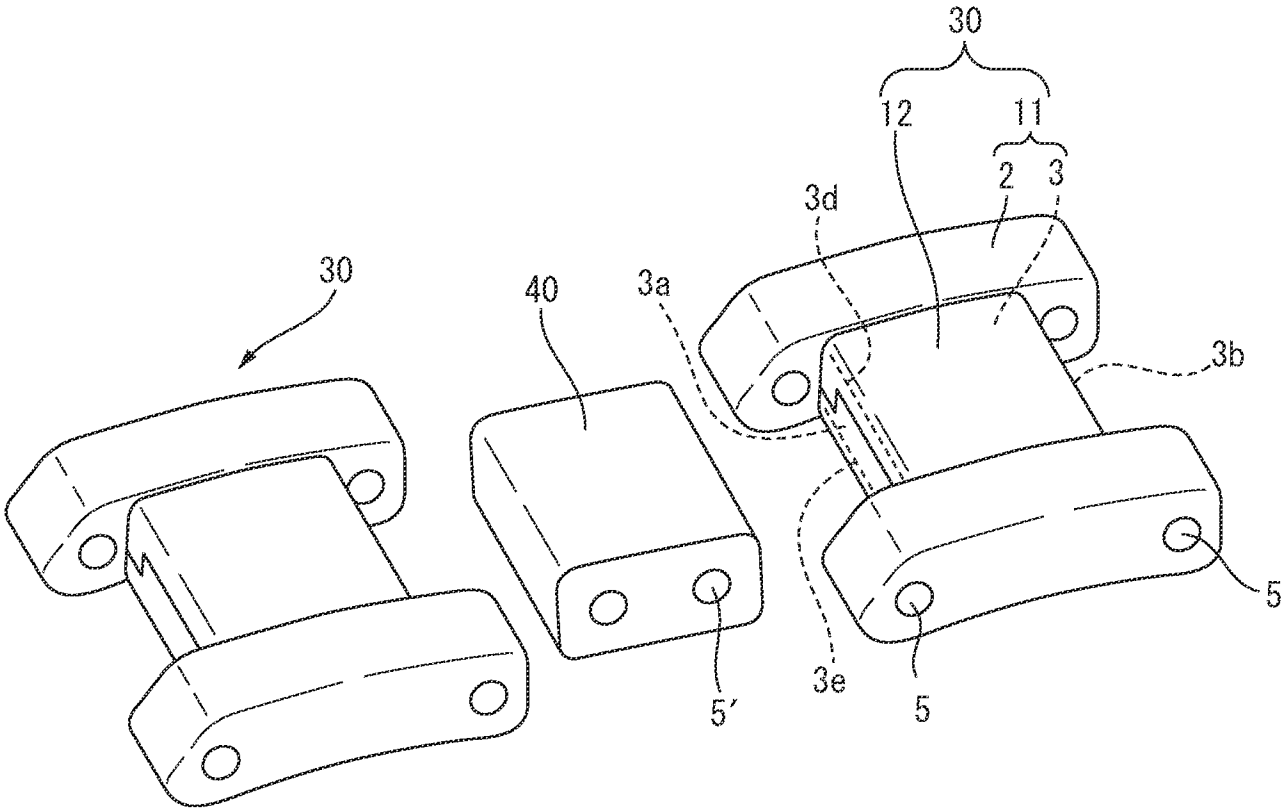
FIG. 22 is a perspective view showing a link member of a third embodiment of the present invention.

FIG. 22 is a perspective view showing a link member of a third embodiment of the present invention.

Figure 23:
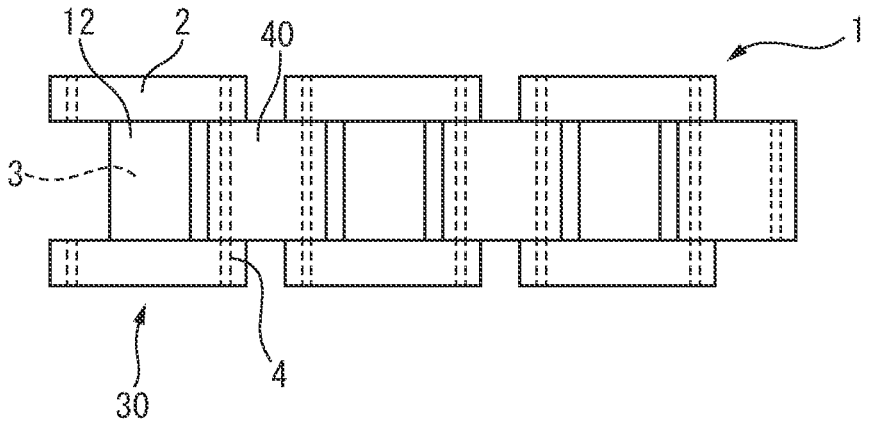
FIG. 23 is a plan view showing the third embodiment of the present invention.
Figure 24:
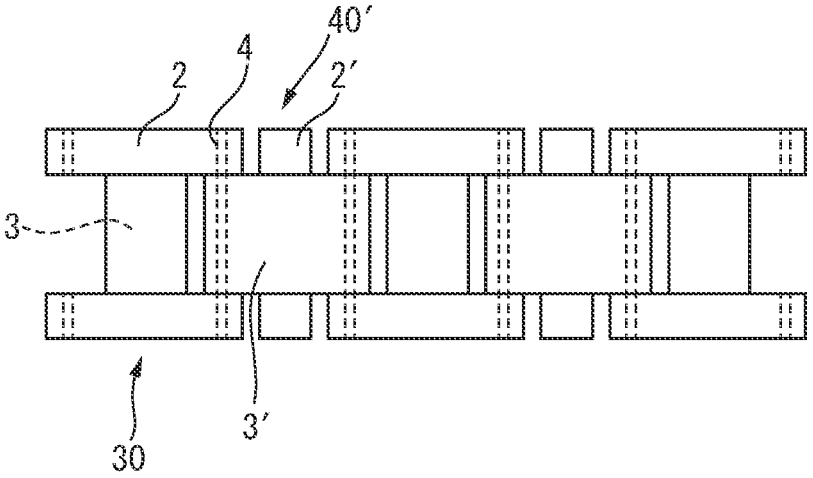
FIG. 24 is a plan view showing the third embodiment of the present invention.

The third embodiment, as shown in FIGS. 22 to 24, is a band 1 comprised of a plurality of link members comprised of two types of link members 30, 40 alternately connected to be able to pivot together. The present embodiment connects link members 30 called "H types" through link members 40 connected with the same by pivot shafts 4 to be able to pivot. Each link member 30 has a middle link part 3, two outside link parts 2 straddling the middle link part, and a sheet member 12 wrapped around the middle link part 3. The middle link part 3 and the outside link part 2 form the link member base part 11. The link member 30 and the link member 40 are connected so that the middle link part 3 is positioned at the inside of the band in the width direction and the outside link parts 2 are positioned at the outside of the band in the width direction. The outside link parts 2 stick out from the middle link part 3 to both the front and rear in the band length direction. The link member base part 11 and link member 30 form an H-shape in a plan view. The middle link part 3 around which the sheet member 12 is wrapped has side parts 3*a*, 3*b* facing the adjoining link members 40. At least one end part in the sheet member 12 is arranged between the top end part and bottom end part at the side part of the middle link part 3 in the thickness direction. In the example shown in FIG. 22, the two end parts of the sheet member 12 are arranged between the top end part 3*d* and bottom end part 3*e* at the side part 3*a* of the middle link part 3. Further, in the example shown in FIG. 22, the two end parts of the sheet member 12 arranged at the top side and bottom side of the middle link part 3 in the thickness direction respectively form a recessed shape and projecting shape, but, of course, the two end parts may also be formed in recessed/projecting shapes reverse to FIG. 22.

Figure 10:
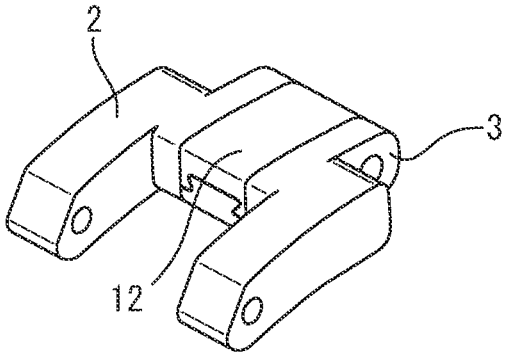
FIG. 10 is a perspective view showing a link member of the second embodiment of the present invention.

The sheet member 12 wrapped around the middle link part 3 has the same width as the middle link part 3 in the band width direction, but also may be shortened to make it like the middle link part 3 of FIG. 10. The sheet member 12 wrapped around the link member base part 11 of the middle link part 3 in the present embodiment is a single strip, but may also be a plurality of strips aiming at an aesthetic effect. The various methods for wrapping the sheet member 12 are the same as the second embodiment.

The first and second embodiments connect the same link members to form a band 1, but as shown in FIG. 23, the third embodiment is a band 1 connecting alternately a plurality of link members comprised of two types of link members 30, 40 to be able to pivot. The link members 40 connected to the link members 30 of the third embodiment are shaped as substantially square shapes in a plan view. In the case of FIG. 22, the link members 40 do not have sheet members 12 wrapped around them. The link member base parts are used as link members. For the link members 40, the base blocks of the first embodiment of FIG. 1(*a*) around which sheet members 12 are wrapped may also be used. Any link member 40 around which the sheet member 12 is wrapped and link member 40 around which the sheet member 12 is not wrapped may be employed considering the design effect of the band 1. As seen in the third embodiment, in other embodiments as well, it is not necessarily required to connect only the same link members to form the band 1. Any connected link members may be suitably selected.

The link members 30, 40 are provided with through holes 5, 5' so that pivot shafts 4 can be inserted through adjoining link members 30, 40 in the width direction of the band. As shown in FIG. 22, the through holes 5 are provided at the outside link parts 2 of the link member 30, while the through holes 5' are provided at the link member 40'. The pivot shaft members forming the pivot shafts 4 (connecting pins) are inserted from the through holes 5 of the outside link parts 2 of the link member 30 through the through holes 5' of the link member 40 and through the through holes 5 of the outside link parts 2 of the link member 30.

The above link member 40 did not have outside link parts, but as shown in FIG. 24, the link member 40' sometimes may also have a middle link part 3' and two outside link parts 2' straddling the middle link part. The middle link part 3' is positioned at the inside in the width direction of the band. The link member 30 and link member 40' are connected so that the outside link parts 2' are positioned at the outside in the width direction of the band. The lengths of the outside link parts 2' in the length direction of the band are shorter than the middle link part 3', while the middle link part 3' sticks out along the length direction of the band from the outside link parts 2' to both the front and back of the band length direction. In this case as well, the sheet member 12 may be wrapped around the middle link part 3' or may not be wrapped around it.

In the present embodiment as well, at least one end part at the sheet member 12 is arranged between the top end part and bottom end part at the side part in the thickness direction whereby the seam of the sheet member wrapped around the link member base part becomes hard to see thanks to the connected link members and a beautiful appearance like a solid member is obtained. Further, the seam of the sheet member is present at the side part, so snags and burrs of end parts of the sheet member wrapped around the link member base part do not scratch the skin of the arm and the feeling against the skin is also good.

Fourth Embodiment

Figure 25:
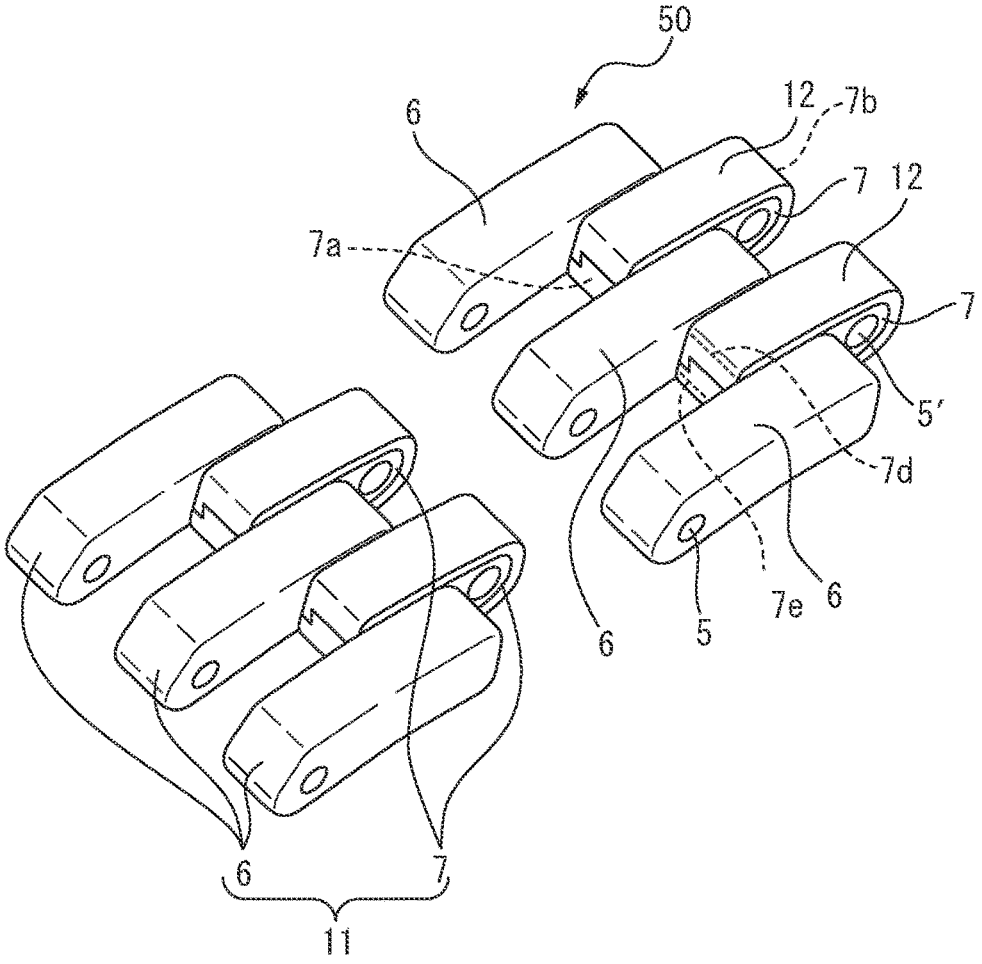
FIG. 25 is a perspective view showing a link member of a fourth embodiment of the present invention.
Figure 26:
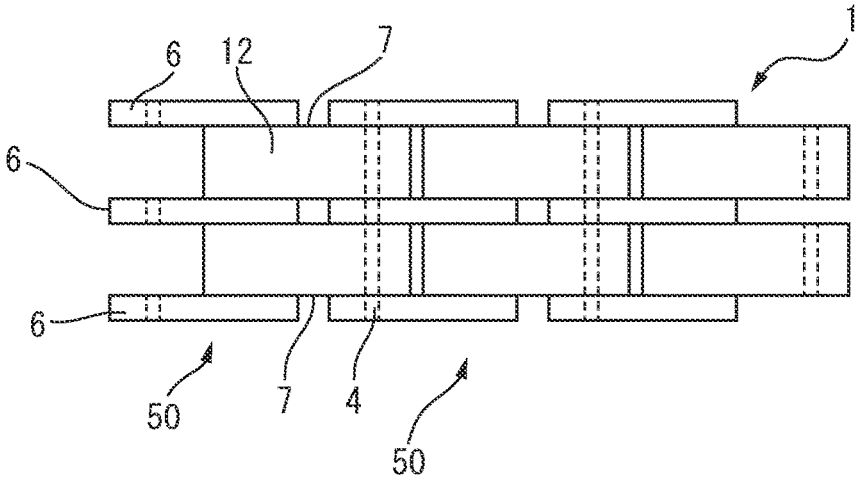
FIG. 26 is a plan view showing the fourth embodiment of the present invention.

FIG. 25 is a perspective view showing a link member of a fourth embodiment of the present invention. FIG. 26 is a plan view showing the fourth embodiment of the present invention.

The fourth embodiment, as shown in FIGS. 25 and 26, is a band 1 comprised of a plurality of link members 50 connected by pivot shafts 4 to be able to pivot with respect to each other. The present embodiment is a band comprised of link members 50 called "E-types" where the same link members 50 are connected. Each of the plurality of link members 50 is shaped with the first link part 6 sticking out from the second link part 7 in a first direction (front in FIG. 25) in the length direction of the band and with a second link part 7 sticking out from the first link part 6 in a second direction (rear in FIG. 25) at an opposite side from the first direction. In one link member 50, the first link part 6, second link part 7, first link part 6, second link part 7, and first link part 6 are formed integrally in the same way as FIG. 18 and form one link member base part 11. At the second link part 7, a sheet member 12 is wrapped so as to cover the entire surface. The various methods for wrapping the sheet member 12 are the same as in the second embodiment.

Each link member 50 is provided with through holes 5, 5' so that pivot shafts 4 can be passed through and inserted in the width direction of the band through the adjoining link members 50. As shown in FIG. 25, the through hole 5 is provided at the projecting part of the first link part 6 at the link member base part 11, while the through hole 5' is provided at the projecting part of the second link part 7 at the link member base part 11. The pivot shaft member forming the pivot shaft 4 is passed from the through hole 6 of the first link part 6 of the link member 50 through the through hole 5' of the second link part 7 forming the adjoining link member 50 and is passed through the through hole 5 of the first link part 6 through the through hole 5' of the second link part 7 forming the adjoining link member 50 to the through hole 5 of the first link part 6. The second link part 7 around which the sheet member 12 is wrapped has side parts 7*a*, 7*b* (referred to as "side parts in band length direction") facing the second link part 7 forming the adjoining link member base part 11. At least one end part at the sheet member 12 is arranged between the top end part 7*d* and bottom end part 7*e* of the side parts 7*a*, 7*b* of the second link part 7 in the thickness direction. In the example shown in FIG. 25, the two end parts of the sheet member 12 are arranged between the top end part 7*d* and bottom end part 7*e* of the side part 7*a* in the thickness direction. Further, in the example shown in FIG. 25, the two end parts of the sheet member 12 arranged at the top side and bottom side of the second link part 7 in the thickness direction are respectively formed as a recessed shape and a projecting shape, but, of course, they may also be formed as recessed and projecting shapes reverse from FIG. 25.

In the above-mentioned fourth embodiment, the link member base part 11 is comprised of three first link parts 6 and two second link parts 7. The invention is not limited to this. The link member base part 11 may also be configured by four first link parts 6 and three second link parts 7 or may be configured by "n" number of first link parts 6 and "n−1" number of second link parts 7 (where, "n" is an integer of 3 or more). That is, in the fourth embodiment, the link member base part around which the sheet member 12 is wrapped has "n" number of first link parts 6 and "n−1" number of second link parts 7. The first link parts 6 sticking out from the second link parts 7 in the first direction in the length direction of the band and the second link parts 7 sticking out from the first link parts 6 in the second direction at the opposite side of the first direction are alternately arranged in the width direction of the band.

In the present embodiment as well, at least one end part at the sheet member 12 is arranged between the top end part and bottom end part at the side part in the thickness direction whereby the seam of the sheet member wrapped around the link member base part becomes hard to see thanks to the connected link members and a beautiful appearance like a solid member is obtained. Further, the seam of the sheet member is present at the side part, so snags and burrs of end parts of the sheet member wrapped around the link member base part do not scratch the skin of the arm and the feeling against the skin is also good.

Figure 27:
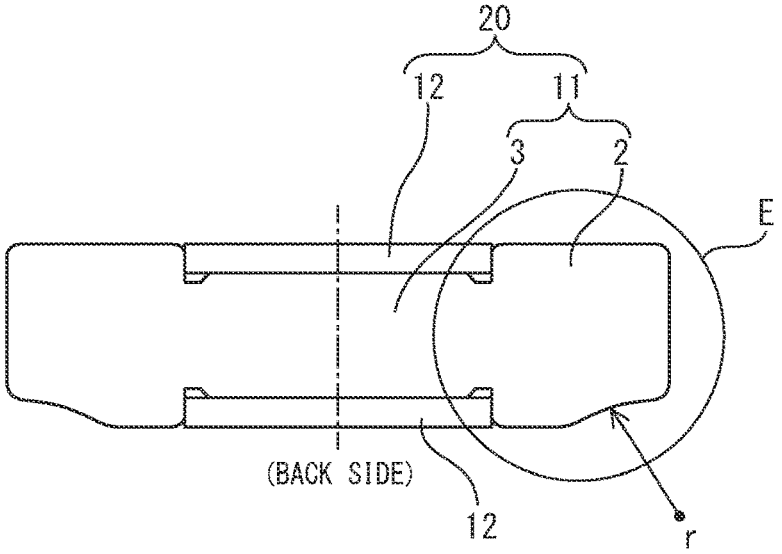
FIG. 27(*a*) is a cross-sectional view of a link member cut in the band width direction when having a shape where the two end parts of the link member at the back surface are sunken in curved surfaces.
Figure 27:
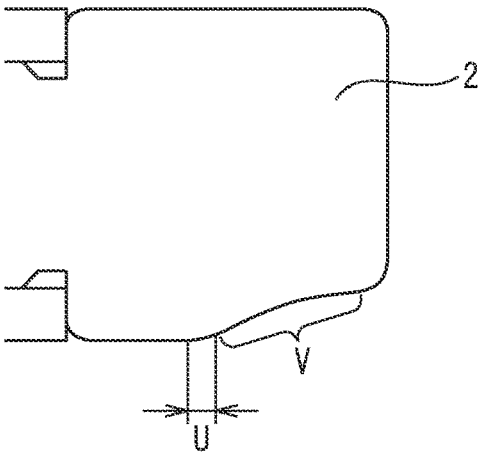
Figure 27:
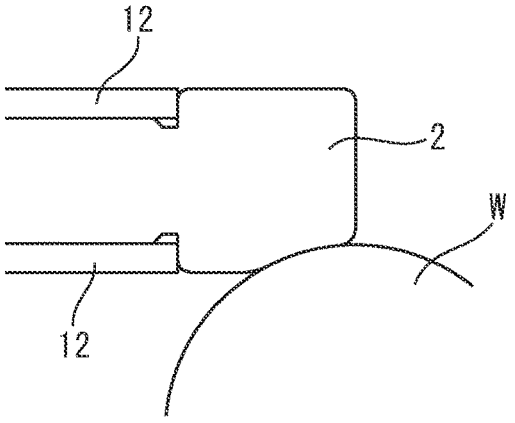
Figure 28:
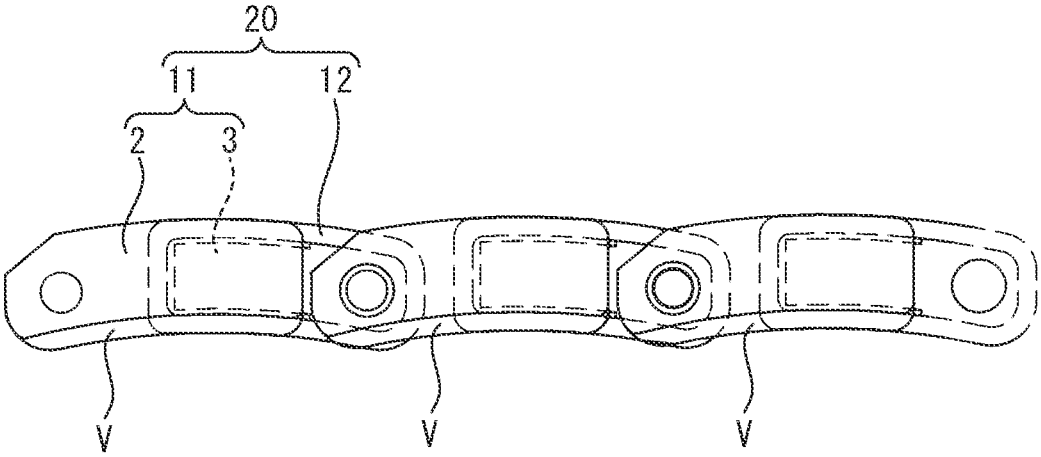
FIG. 28 is a side surface view connecting link members of FIG. 27(*a*).
Figure 29:
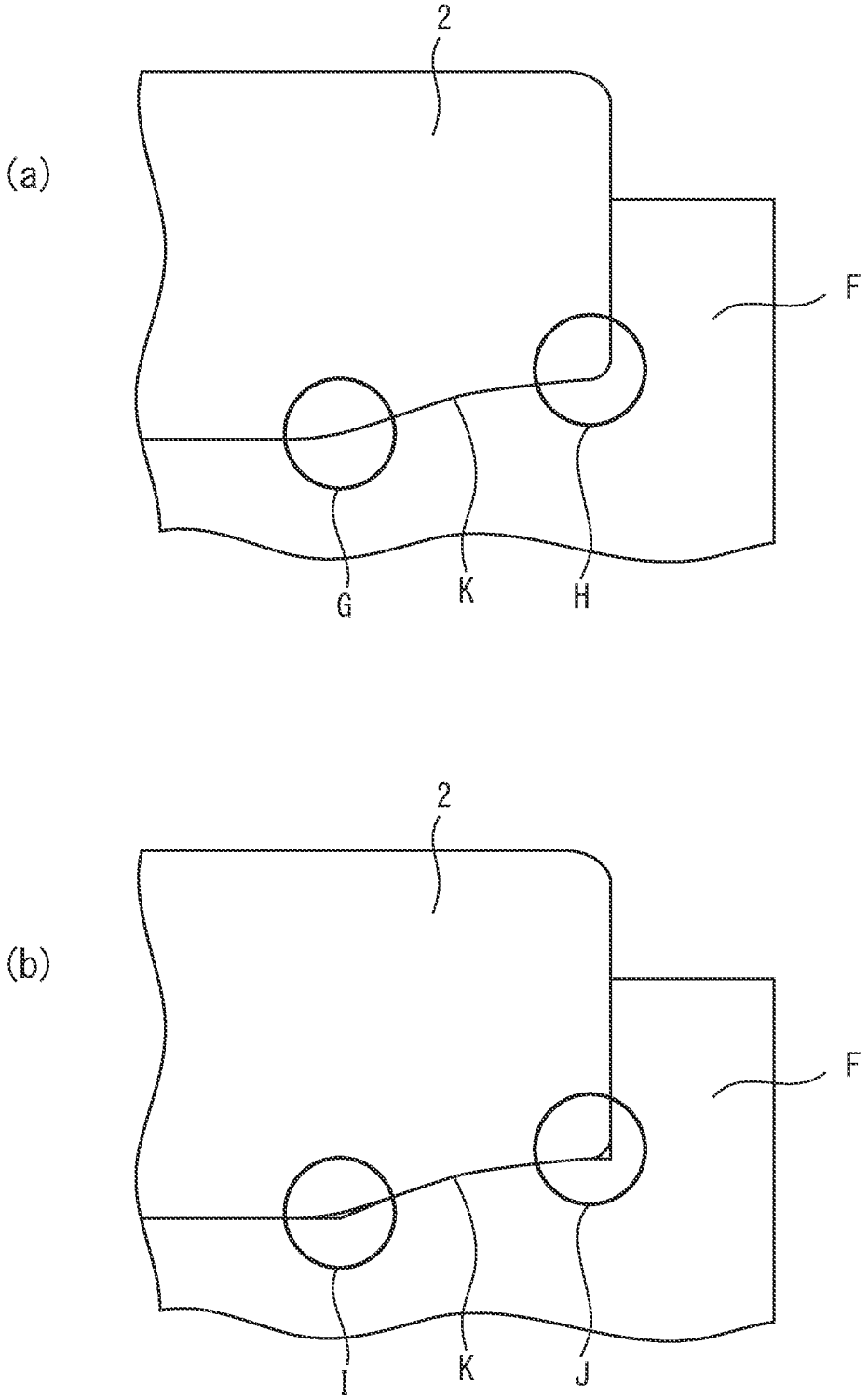
FIGS. 29(*a*), (*b*) are explanatory views of the cross-sections of a die for forming the link member of FIG. 27(*a*).
Figure 30:
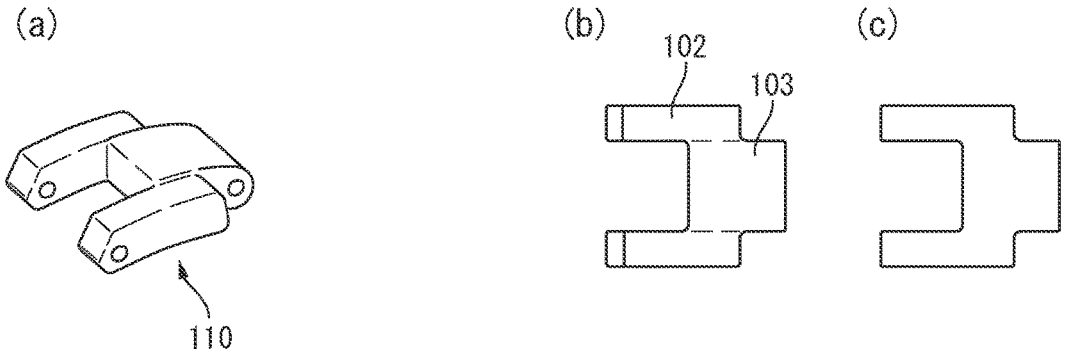
FIG. 30 PRIOR ART
FIG. 30(*a*) is a perspective view showing a prior art.
Figure 31:
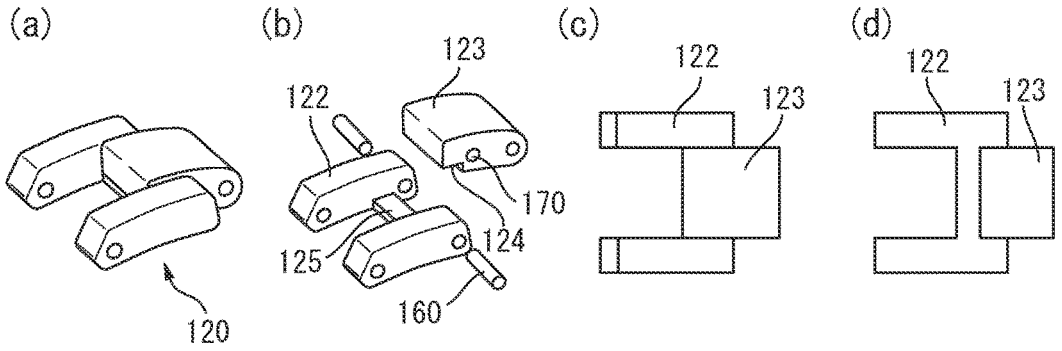
FIG. 31 PRIOR ART
FIG. 31(*a*) is a perspective view showing the prior art.

FIG. 27(*a*) is a cross-sectional view of a link member cut in the band width direction when having a shape where the two end parts of the link member at the back surface are sunken in curved surfaces. FIG. 27(*b*) is an enlarged part of a part E of FIG. 27(*a*). FIG. 27(*c*) is an explanatory view explaining a shape where the two end parts of the link member at the back surface side are sunken in curved surfaces. FIG. 28 is a side surface view connecting link members of FIG. 27(*a*). FIGS. 29(*a*), (*b*) are explanatory views of the cross-sections of a die for forming the link member of FIG. 27(*a*).

Next, referring to FIG. 3, FIGS. 27(*a*) to (*c*), and FIG. 28 as one example, an embodiment in the case where the slanted parts V of the two end parts at the back surface sides of the link members 20 of the second embodiment have cross-sectional shapes sunken into curved surface shapes will be explained. In the present embodiment, the two end parts at the back surface sides of the outside link parts 2 are formed into cross-sectional shapes sunken into radius "r" arc shapes. The cross-sectional shape sunken into a curved surface shape of FIGS. 27(*a*), (*b*) mimics the drafting symbol R and will also be referred to below as the "reverse R part shape". The rest of the parts are the same as the second embodiment. As shown in FIG. 28, the reverse R part shape is not limited to a shape with a constant width of the slanted part V in the band length direction or a constant reverse R part shape and can be formed to a shape with a changing width of the slanted part in the band length direction or changing reverse R part shape.

As a link member forming a conventional band, one not formed with slanted parts V at the two end parts at the back surface side, but having angular parts where the back surface and side surfaces of the link member intersect are close to sharp angle shapes is used. A band using link members of such shapes had the angular parts where the back surfaces and side surfaces of the link members contact the skin and cause an uncomfortable feeling and had the parts of the skin pushed against by the angular parts sunken in leaving angular marks. As opposed to this, in the present embodiment, the parts of the slanted parts V of the two end parts at the back surface side at the outside link part 20 are separated from the skin in the state with the band attached to the arm so the portions angularly sticking out will never touch the skin. Further, for an arm which the band continuously contacts, the contact area by which the back surfaces of the outside link parts 2 contacts the arm is reduced. Due to these, the load of the band on the skin becomes smaller. Further, to reduce the load of the band on the skin more, preferably the portions where the link member 20 contacts the skin, are not formed with portions with angularly protecting shapes. For this reason, the boundary parts U between the back surfaces and the slanted parts V of the outside link parts 2 shown in FIG. 27(*b*) are formed with smoothly curved surfaces not sticking out from the back surface of the outside link parts 2. Further, as seen in FIG. 27(*c*), when the two end parts at the back surface side of the outside link part 2 of the link member are touched by a finger indicated as W, the front end of the finger fits at the part of the reverse R part shape of the recessed shape, so the odd feeling at the time of contact is eliminated and the tactile feel is improved. As opposed to this, as described in PLT 7 and PLT 8, there is also a prior art band configured with the two end parts at the back surface side of the link member formed by straight taper shapes. In such a band, when a taper shape part is touched by a finger W, the finger and the taper shape part contact each other by a point or part of the surface of the finger touches the taper shape part in a state deformed to a flat shape. Therefore, these bands do not feel to fit well when the part of the reverse R part shape is touched by a finger W. Furthermore, when, like these prior art bands, the parts of the reverse R part shapes are made straight taper shapes, the link member is cut or polished to process it into taper shapes. Therefore, these bands of the prior art require two to three cutting processes and one to two polishing processes for forming a taper shape. As opposed to this, in the case of the reverse R shape of the present embodiment, the part of the reverse R shape can be formed by a single press process by press-forming.

The formation of the reverse R part shape when using a press-forming using a die to form the outside link parts 2 will be explained. As seen in FIG. 29, the die itself is formed with a shape K (shape transferring reverse R part shape). It is aimed at forming a reverse R part shape from the shaping stage. Further, for the circled G and H parts of FIG. 29(*a*), due to the characteristics of a press-forming die, to get the circled I and J parts of FIG. 29(*b*), even if the die side does not have a roundness in an angular part or corner, the outside link part 2 is formed with somewhat roundness in the angular part or corner. However, to make it the targeted shape, as shown the circled G and H parts of FIG. 29(*a*), the die has to have the roundness of the targeted values in angular parts or corner. The processing of the two end parts of the back surface sides of the outside link parts 2 of the present embodiment of course is not limited to a press-forming die, but using a press-forming die is preferable in terms of cutting processing costs and processing time.

Further, in the present embodiment, the slanted part is formed in a cross-sectional shape sunken in a radius "r" arc shape, but the invention is not necessarily limited to this. The cross-sectional shape of the slanted part V may also be made any cross-sectional shape sunken in a curved surface shape. That is, the present embodiment is a band comprised of a plurality of link members connected with each other by pivot shafts to be able to pivot, characterized in that at the two end parts of the band in the width direction, at the respective back surfaces of the plurality of link members, slanted parts V formed to shapes gradually becoming thinner in thickness from the insides of the link member toward the side surfaces are provided along the length direction of the band and in that the cross-sectional shapes of the slanted parts V are shapes sunken in curved surface shapes. Furthermore, the boundary parts U of the back surfaces and slanted part V (see FIG. 27(*b*)) may also be designed to be formed in smooth curved surfaces not sticking out from the back surfaces. The present embodiment can be applied to not only the link members 20 of the second embodiment, but also the above-mentioned embodiments including the base block type of the first embodiment. For example, if applying the present embodiment to this base block type link member, the two ends of the back surface of the link member base part 11 in the band width direction may also be formed to a reverse R part shape. Furthermore, if applying the present embodiment to the link members of the different embodiments, the link members of the different embodiments can also be applied to link members around which sheet members 12 are not wrapped regardless of the existence of the sheet members 12.

Note that the technical scope of the present invention is not limited to the above-mentioned embodiments and includes various changes to the above embodiments within a scope not deviating from the gist of the present invention. That is, the specific configurations mentioned in the embodiments are just examples and can be suitably changed.

REFERENCE SIGNS LIST

1. band
2. outside link part
3. middle link part
4. pivot shaft
5, 5'. through holes
10, 20, 30, 40, 50, 60. link members

The invention claimed is:

1. A band comprising:

pivot shafts extending in a width direction of the band and a plurality of link members connected to each other so as to be pivoted by the pivot shafts, in said band, at least on of said plurality of link members has a sheet member extending in a length direction perpendicular to the width direction and having two end parts at the end of the length direction, and a wrapped member around which said sheet member is wrapped, said wrapped member has a pair of side parts facing an adjoining link member, wherein the pair of side parts face each other and each of the pair of side parts has a top end part at the upper end thickness direction of the side part and a bottom end part at the lower end of the thickness direction of the side part, wherein the thickness direction is a direction perpendicular to the length direction, and both of said two end parts of said sheet member are arranged to make them face each other between the top end part and bottom end part of one of said pair of side parts in a thickness direction so as to face an adjoining link member.

2. The band according to claim 1, wherein said wrapped member further has a top surface contacted with the pair of side parts at the top end parts and a bottom surface contacted with the pair of side parts at the bottom end parts, and the top end part is formed to a shape curved from the top surface to one of said pair of side part side and the bottom surface the bottom end part is formed to a shape from the bottom surface to one of said side part.

3. The band according to claim 2, wherein said sheet member further has a first engagement part at the top end part and a second engagement part at bottom end part, and the first engagement part and second engagement part are formed so as to be mutually engaged.

4. The band according to claim 3, wherein a gap is formed between the first engagement part and second engagement part when the first engagement part and second engagement part are mutually engaged.

5. The band according to claim 1, wherein the wrapped member has a pair of outside link parts arranged outer edge of the band in the width direction and a middle link part arranged between the pair of outside link parts and sticking out from the pair of outside link parts in the length direction, and said sheet member is wrapped around at least one of said middle link part and said pair of outside link parts in at least one of the length direction and the width direction.

6. The band according to claim 5, wherein said pair of outside link parts are fixed to said middle link part, and two wrapped members adjoining each other included in said wrapped members are connected each other by connecting said middle link part of one of the two wrapped members with said pair of outside link parts of another of the two wrapped members.

7. The band according to claim 6, wherein each of the plurality of link members has a shape where said outside link parts stick out from said middle link part in a first direction along a length direction of said band and said middle link part has a wrapped member sticking out from said outside link parts in a second direction at an opposite side to said first direction, said pivot shaft is provided between said pair of outside link parts, the respective middle link parts are connected so as to adjoin each other in a length direction of said band, each of the middle link parts forming said wrapped members is formed with a first side part positioned in said first direction and a second side part positioned in said second direction, and said at least one end part at said sheet member is arranged at said first side part of said middle link part.

8. The band according to claim 1, wherein the wrapped member has "n" number of first link parts and "n−1" number of second link parts (where, "n" is an integer of 3 or more), and, a first link part sticking out from said second link part in a first direction along a length direction of said band and a second link part sticking out from said first link part in a second direction at an opposite side to said first direction are alternately arranged in a width direction of said band.

9. The band according to claim 1, wherein said wrapped member further has a top surface contacted with the side parts at the top end parts and a bottom surface contacted with the side parts at the bottom end parts, at least one surface of the top surface and the bottom surface is formed with a groove at an inside of said band in a width direction extending the length direction and said sheet member is wrapped so as to be fitted into said groove.

10. The band according to claim 1, wherein at least one of the pair of side parts of said middle link part is formed with a groove between the top end part and bottom end part, and the sheet member has at least one end part fit in the groove.

* * * * *